US008182059B2

(12) United States Patent
Sakakibara et al.

(10) Patent No.: US 8,182,059 B2
(45) Date of Patent: May 22, 2012

(54) IMAGE PRINTING DEVICE

(75) Inventors: Akihiro Sakakibara, Toyota (JP); Yasuhira Ota, Yatomi (JP); Kohei Terada, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 255 days.

(21) Appl. No.: 12/730,982

(22) Filed: Mar. 24, 2010

(65) Prior Publication Data

US 2011/0050762 A1 Mar. 3, 2011

(30) Foreign Application Priority Data

Aug. 31, 2009 (JP) ..... 2009-201005

(51) Int. Cl.
*B41J 29/393* (2006.01)
*B41J 29/38* (2006.01)

(52) U.S. Cl. ..... 347/16; 314/19

(58) Field of Classification Search ..... 347/16, 347/19
See application file for complete search history.

(56) References Cited

U.S. PATENT DOCUMENTS

| | | | | |
|---|---|---|---|---|
| 2005/0168187 | A1 | 8/2005 | Uchiyama et al. | |
| 2008/0073832 | A1 | 3/2008 | Sudo et al. | |
| 2009/0080006 | A1 * | 3/2009 | Aoki | 358/1.9 |

FOREIGN PATENT DOCUMENTS

| | | | |
|---|---|---|---|
| JP | H01-233958 | A | 9/1989 |
| JP | H10-038902 | A | 2/1998 |
| JP | 2005-168280 | A | 6/2005 |
| JP | 2006-224380 | A | 8/2006 |
| JP | 2007-021933 | A | 2/2007 |
| JP | 2007-161389 | A | 6/2007 |
| JP | 2007-197186 | A | 8/2007 |
| JP | 2008-018604 | A | 1/2008 |
| JP | 2008-068479 | A | 3/2008 |

* cited by examiner

*Primary Examiner* — Julian Huffman
(74) *Attorney, Agent, or Firm* — Baker Botts L.L.P.

(57) ABSTRACT an image printing device comprises a transfer roller configured to transfer a printing medium in a transfer direction, a first sensor configured to detect a rotation amount of the transfer roller, a carriage mounted with a printhead. The image printing device further comprises a second sensor mounted to the carriage and configured to detect the printing medium. The image printing device further comprises a reference member disposed at a position opposing to the second sensor and a drive transmission mechanism configured to move the reference member in conjunction with a rotation of the transfer roller. The image printing device determines a position of an origin of the transfer roller based on detection results of the first sensor and the second sensor.

7 Claims, 18 Drawing Sheets

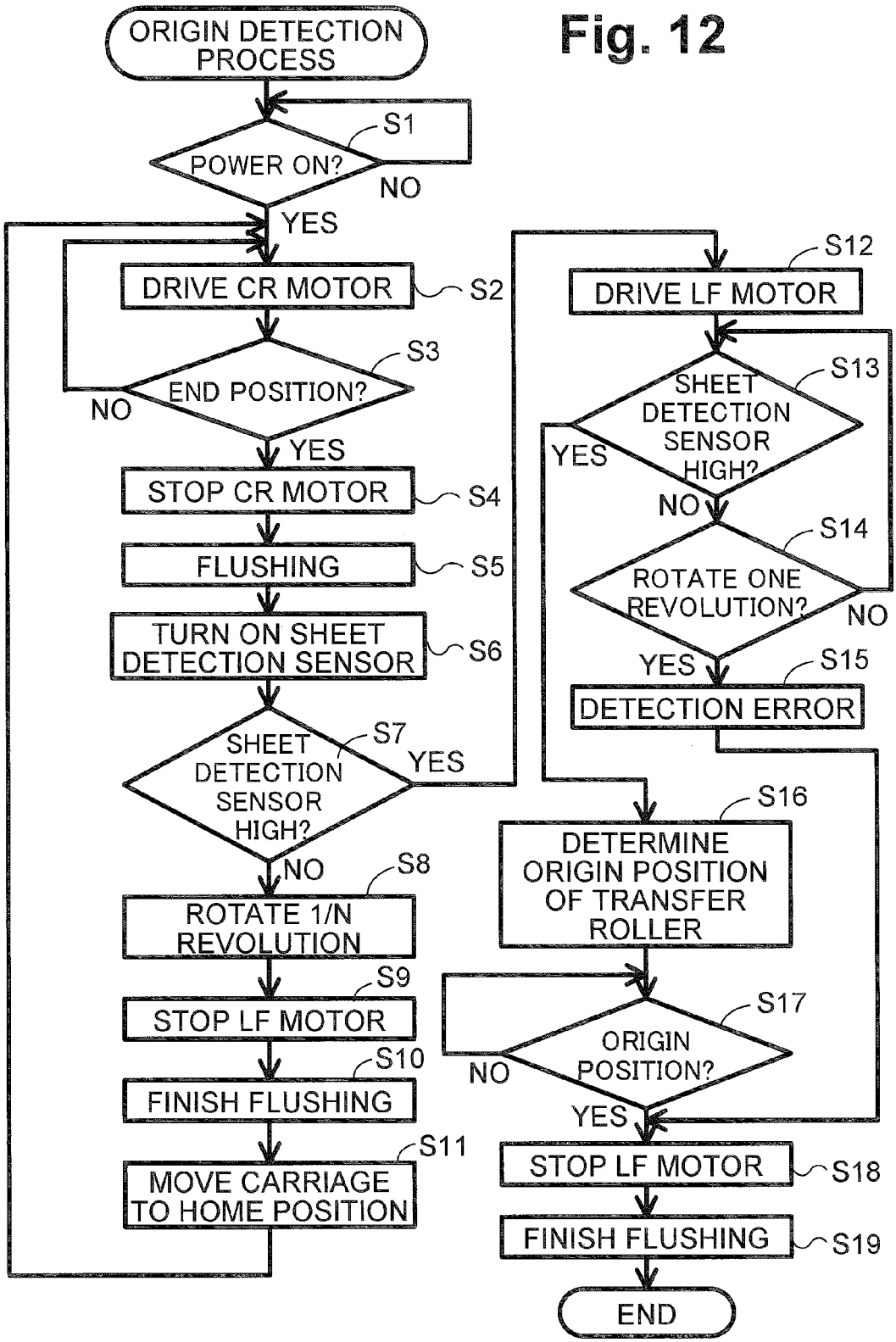
ORIGIN DETECTION PROCESS
Fig. 12
S1
POWER ON?
NO
YES
DRIVE CR MOTOR
S2
S3
END POSITION?
NO
YES
STOP CR MOTOR
S4
FLUSHING
S5
TURN ON SHEET DETECTION SENSOR
S6
S7
SHEET DETECTION SENSOR HIGH?
YES
NO
S8
ROTATE 1/N REVOLUTION
S9
STOP LF MOTOR
S10
FINISH FLUSHING
S11
MOVE CARRIAGE TO HOME POSITION
S12
DRIVE LF MOTOR
S13
SHEET DETECTION SENSOR HIGH?
YES
NO
S14
ROTATE ONE REVOLUTION?
NO
YES
S15
DETECTION ERROR
S16
DETERMINE ORIGIN POSITION OF TRANSFER ROLLER
S17
ORIGIN POSITION?
NO
YES
STOP LF MOTOR
S18
FINISH FLUSHING
S19
END

IMAGE PRINTING DEVICE

CROSS REFERENCE TO RELATED APPLICATION

The present application claims priority from Japanese Patent Application No. 2009-201005, filed on Aug. 31, 2009, the disclosure of which is incorporated herein by reference in its entirely.

BACKGROUND

1. Technical Field

The present invention relates to an image printing device that determines the position of an origin of a transfer roller.

2. Related Art

An image printing device performs image printing by transferring a printing medium such as printing paper. A transfer roller is known as means for transferring the printing medium. The transfer roller is operated to transfer the printing medium by being rotated with contacting the printing medium. For implementation of high-quality image printing, the printing medium should be transferred with good accuracy. In consideration thereof, there is a technology known for correcting the rotation amount of a transfer roller in accordance with the position of the origin detected by using a sensor independently provided for detecting the position of the origin of the transfer roller.

SUMMARY

However, providing the sensor independently for detecting the position of the origin of the transfer roller may increase the device size or the cost. A need has arisen to provide an image printing device that determines the position of the origin of the transfer roller with a reduced device size or cost.

According to an embodiment of the invention, an image printing device comprises a transfer roller configured to transfer a printing medium in a transfer direction and a driving source which rotates the transfer roller. The image printing device further comprises a first sensor configured to detect a rotation amount of the transfer roller and a printhead which performs image printing onto the printing medium transferred by the transfer roller. The image printing device still further comprises a carriage configured to move in a movement direction intersecting the transfer direction. The carriage is mounted with the printhead. Moreover, the image printing device comprises a second sensor mounted to the carriage. The second sensor is configured to detect the printing medium. The image printing device further comprises a reference member disposed at a position opposing to the second sensor and a drive transmission mechanism configured to move the reference member in conjunction with a rotation of the transfer roller. The image printing device still further comprises a controller configured to control the driving source, the printhead, and the carriage. The controller is configured to move the carriage to a detection position where the second sensor detects the reference member, to drive the driving source to move the reference member via the drive transmission mechanism, and to determine the position of the origin of the transfer roller based on a detection result of the first sensor and a detection result of the second sensor.

BRIEF DESCRIPTION OF THE DRAWINGS

For a more complete understanding of the present invention, the needs satisfied thereby, and the features and advantages thereof, reference now is made to the following descriptions taken in connection with the accompanying drawings wherein:

FIG. 9A is a schematic view of an encoder disk and that of an optical sensor, and FIG. 9B is a graph exemplarily showing the transfer amount of the printing paper per pulse signal coming from a rotary encoder;

FIG. 12 is an exemplary flowchart of a process procedure to be executed in the multifunctional device in response to when the multifunctional device is turned on;

DESCRIPTION OF PREFERRED EMBODIMENTS

Embodiments of the invention and their features and advantages may be understood by referring to FIGS. 1-21, like numerals being used for like corresponding parts in the various drawings. In the description given below, an entire configuration of a color printer as an example of an image forming apparatus in brief first, and then characteristic portions of the invention will be described in detail.

Schematic Configuration of Multifunctional Device 10

Figure 1:
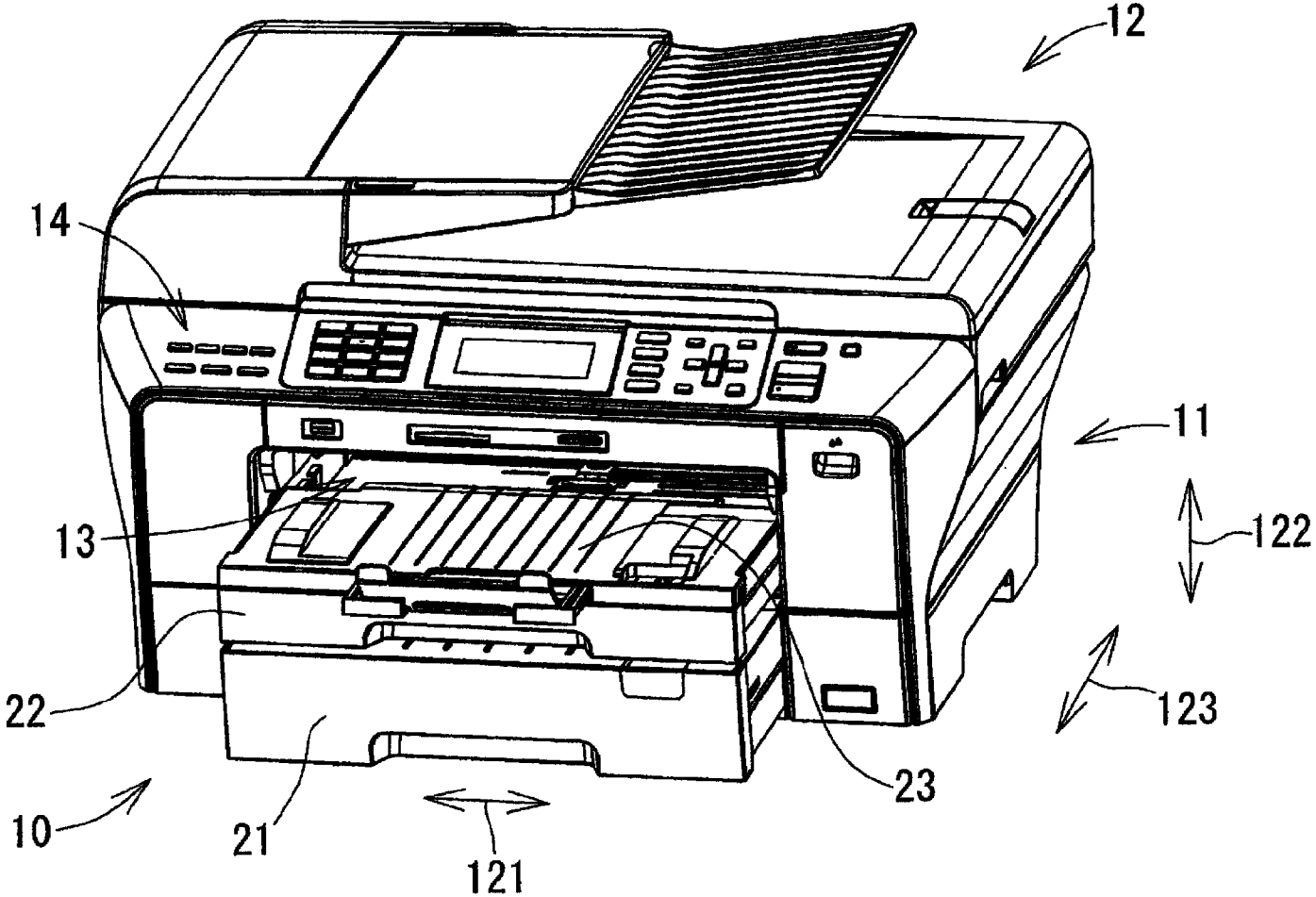
FIG. 1 is a perspective view of a multifunctional device, showing the configuration thereof viewed from the outside.

As shown in FIG. 1, a multifunctional device 10 is configured to include integrally a printer section 11 and a scanner section 12, and provides various functions, i.e., printing, scanning, copying, and faxing. Note here that the multifunctional device 10 is an example of a image printing device and is not necessarily to include the scanning section 12. An alternative image printing device may be implemented as a single-function printer, i.e., printer without the functions of scanning and copying. As such, no detailed description is given here about the configuration of the scanner section 12.

In the multifunctional device 10, the printer section 11 is disposed on the lower side. The printer section 11 is formed with an aperture 13 on the front side thereof. The printer section 11 is attached with sheet feeding cassettes 21 and 22 via the aperture 13. The sheet feeding cassettes 21 and 22 are respectively provided thereon with a standard-sized rectangular printing paper(s) 50 (shown in FIG. 2). In the printer section 11, the printing paper 50 is directed selectively from either the sheet feeding cassette 21 or 22 into the printer section 11. This printing paper 50 is ejected onto an upper surface 23 of the sheet feeding cassette 22 after printing of an image by a printing section 40 (shown in FIG. 2). The upper surface 23 serves as a sheet ejection tray. The printing paper 50 is an example of the printing medium.

The multifunctional device 10 is used while being connected mainly to an external information device (not shown) such as computer. The printer section 11 is operated for image printing onto the printing paper 50 based on printing data provided by the external information device, and/or image data of a document read by the scanner section 12.

The multifunctional device 10 is provided with an operation panel 14 on the upper front portion thereof. The operation panel 14 is provided with a display for display of various types of information, and input keys for input of information. The multifunctional device 10 is operated based on command information provided from the operation panel 14, or command information coming from the external information device via a printer driver, a scanner driver, or others.

Printer Section 11

In the below, by referring to FIGS. 2 to 7C as appropriate, the configuration of the printer section 11 is described.

Figure 2:
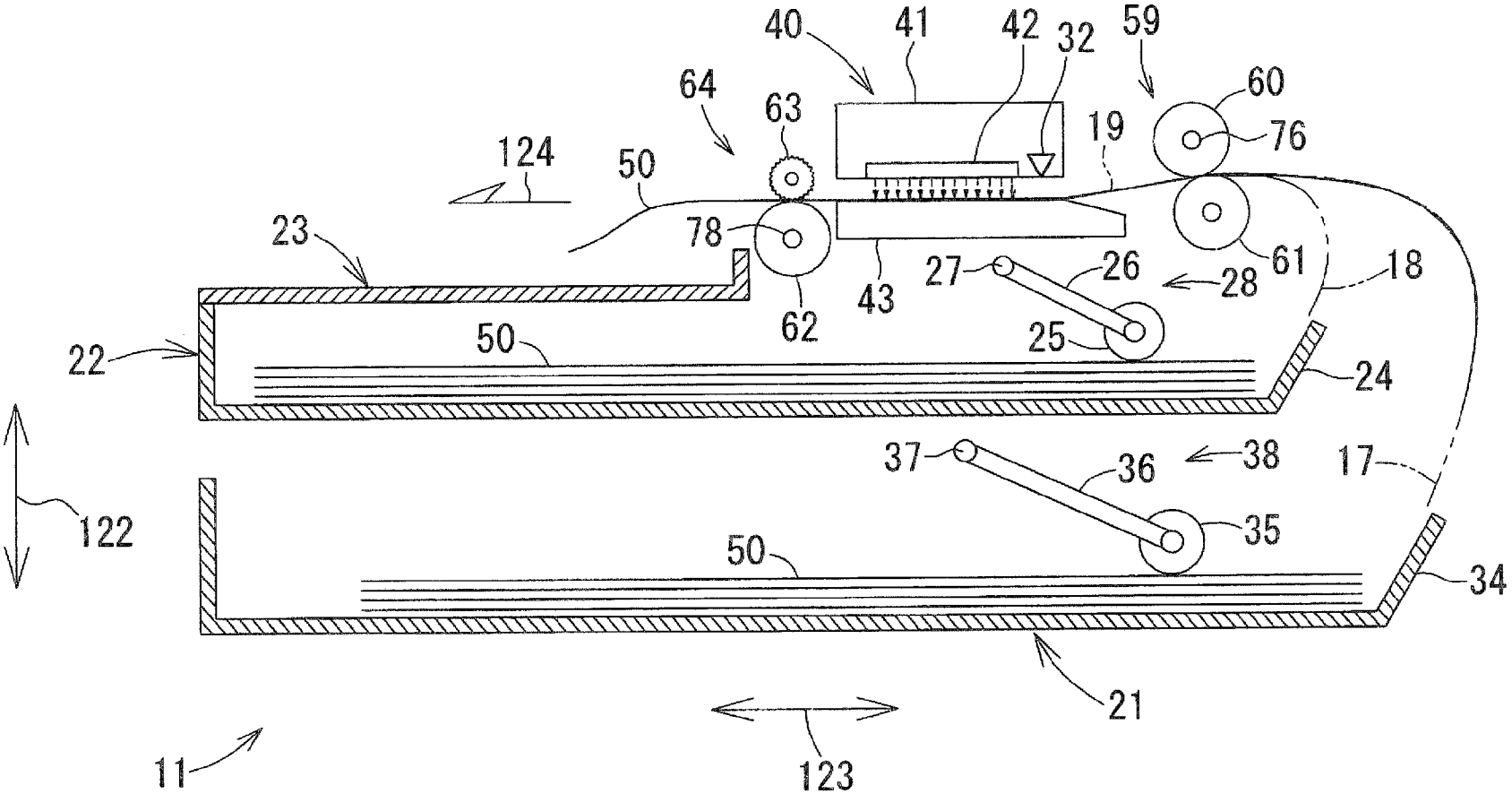
FIG. 2 is a schematic view of a printer section, showing the internal configuration thereof.

As shown in FIG. 2, the sheet feeding cassettes 21 and 22 are disposed one on the other with the sheet feeding cassette 22 located on the upper side. The sheet feeding cassettes 21 and 22 are both provided for storing therein the printing paper 50 for image printing. With these two sheet feeding cassettes 21 and 22 provided separately as such, the printing paper 50 varying in size and type can be stored.

The sheet feeding cassette 21 is shaped like a case whose surface on the rear of the multifunctional device 10 is partially open, and carries a stack of the printing paper 50 in the internal space thereof. Such a sheet feeding cassette 21 is ready for storage of the printing paper 50 of various sizes equal to or smaller than the A3 size, e.g., the A4 size, the B5 size, and the card size.

The sheet feeding cassette 22 is shaped like a case whose surface on the rear of the multifunctional device 10, i.e., on the right side in FIG. 2, is partially open, and carries a stack of the printing paper 50 in the internal space thereof. Such a sheet feeding cassette 22 is ready for storage of the printing paper 50 of various sizes equal to or smaller than the A3 size, e.g., the A4 size, the B5 size, and the card size. The upper surface 23 of the sheet feeding cassette 22 is located on the front side of the multifunctional device 10, i.e., on the left side in FIG. 2.

First Supply Section 28

The sheet feeding cassette 22 has an inclined plate 24, which is provided thereon with a curved transfer path 18. When the sheet feeding cassette 22 is attached to the printer section 11, the inclined plate 24 is positioned below the transfer path 18, and a first supply section 28 comes above the sheet feeding cassette 22. The first supply section 28 is provided with a sheet feeding roller 25, an arm 26, and a shaft 27. The sheet feeding roller 25 is provided at the tip end side of the arm 26 to be able to rotate. The arm 26 is provided, to be able to move circular, to the shaft 27 that is supported by the chassis of the printer section 11. The arm 26 is biased to move circular to the side of the sheet feeding cassette 22 by the self weight or by the elastic force of a spring or others.

Second Supply Section 38

The sheet feeding cassette 21 has an inclined plate 34, which is provided thereon with a curved transfer path 17. When the sheet feeding cassette 21 is attached to the printer section 11, the inclined plate 34 is positioned below the transfer path 17, and a second supply section 38 comes above the sheet feeding cassette 21. The second supply section 38 is provided with a sheet feeding roller 35, an arm 36, and a shaft 37. The sheet feeding roller 35 is provided at the tip end side of the arm 36 to be able to rotate. The arm 36 is provided, to be able to move circular, to the shaft 37 that is supported by the chassis of the printer section 11. The arm 36 is biased to move circular to the side of the sheet feeding cassette 21 by the self weight or by the elastic force of a spring or others.

Transfer Paths 17, 18, and 19

The printer section 11 is provided therein with a transfer path 19, which is an extension of the transfer paths 17 and 18. This transfer path 19 is provided for transfer of the printing paper 50 thereover coming along the transfer path 17 or 18, and is extended all the way to above the upper surface 23 of the sheet feeding cassette 22 from the position where the transfer paths 17 and 18 are merged to the front side of the multifunctional device 10.

Platen 43

Figure 3:
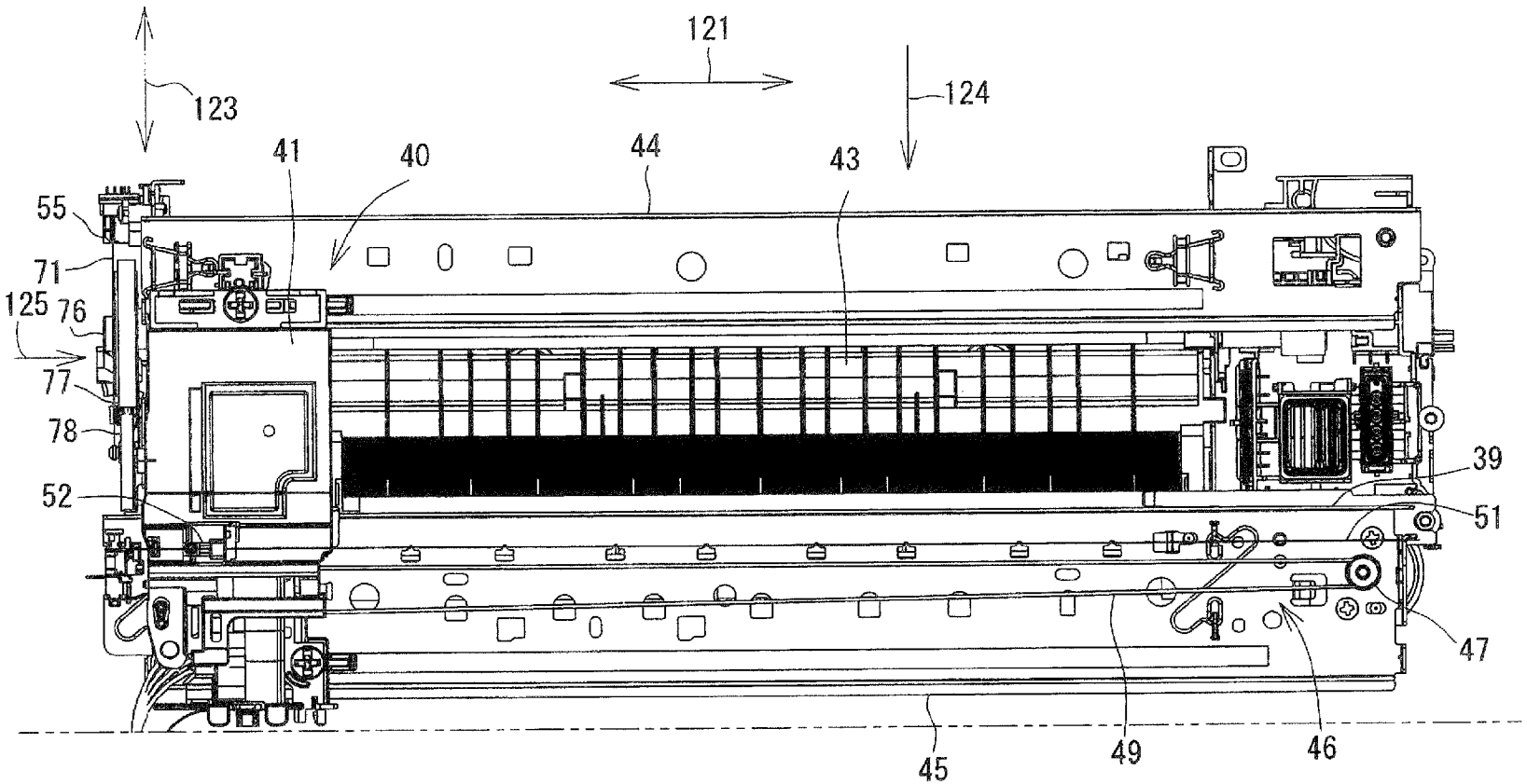
FIG. 3 is a partial plan view of the printer section, showing the internal configuration thereof.

The transfer path 19 is provided with a platen 43 (shown in FIGS. 2 and 3). The platen 43 serves to support from below the printing paper 50 coming along the transfer path 19. This platen 43 is provided with the printing section 40 on the upper side thereof. This printing section 40 will be described later. The upper surface of the platen 43 is colored to have a reflectivity different from that of the printing paper 50. The printing paper 50 is generally white, and thus the upper surface of the platen 43 is colored black, for example.

Figure 4:
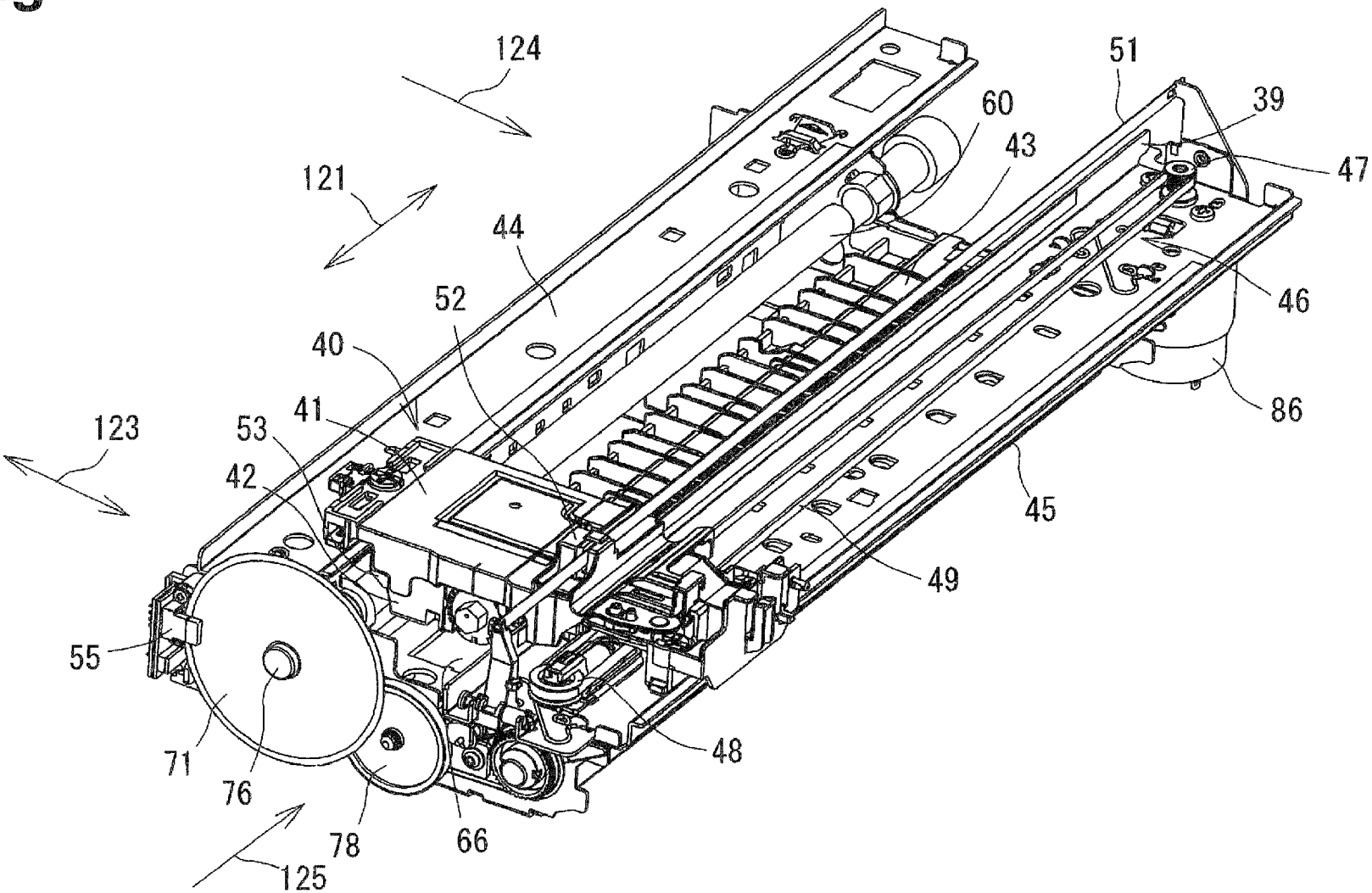
FIG. 4 is a partial perspective view of the printer section, showing the internal configuration thereof.
Figure 5:
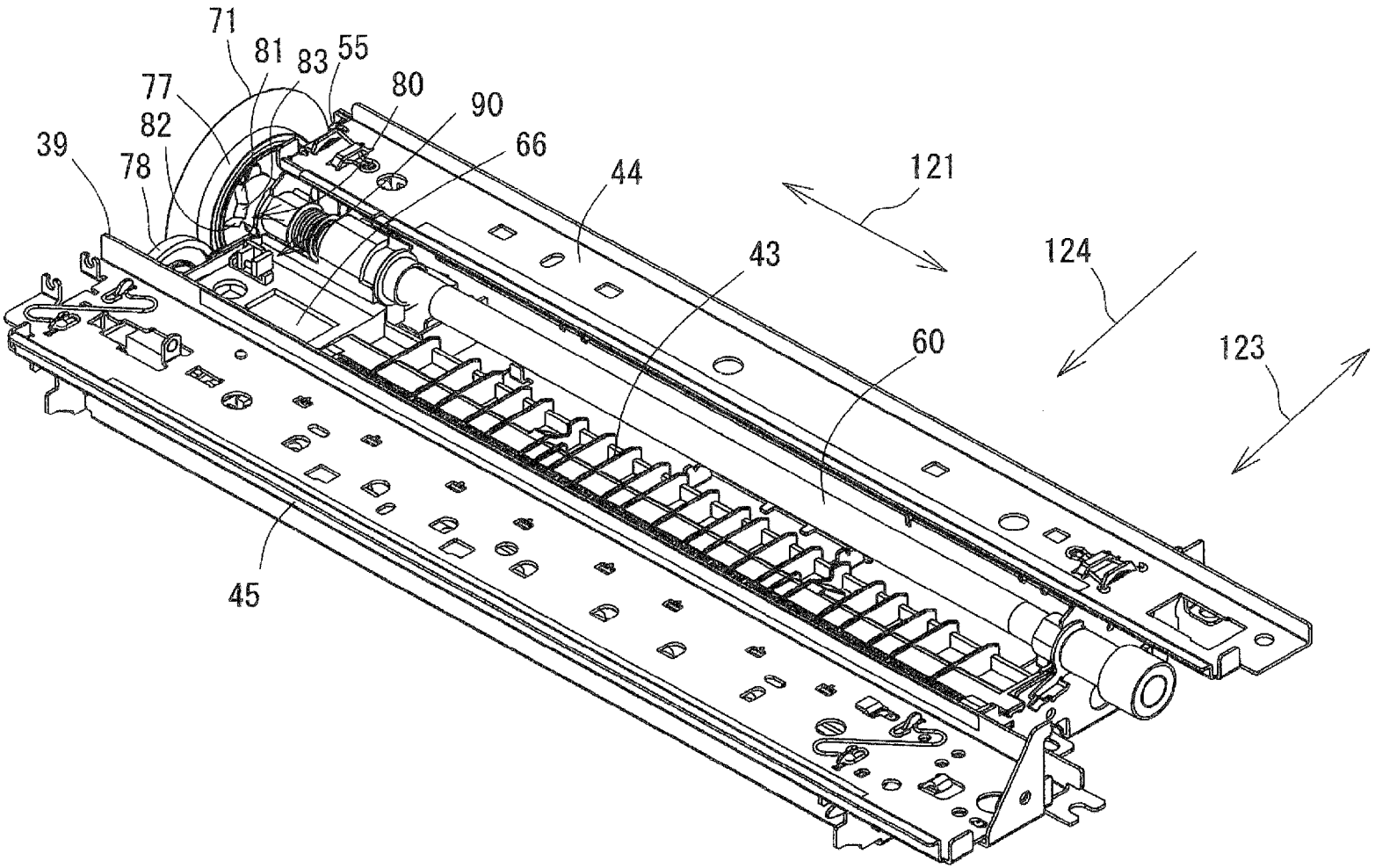
FIG. 5 is a partial perspective view of a transmission gear and therearound, showing the configuration thereof.

As shown in FIGS. 4 and 5, a waste ink tray 66 (an example of an ink receiving section) is provided at one end of the platen 43 in a cross direction 121 and on the side of a transmission gear 77 that will be described later (shown in FIG. 3). The waste ink tray 66 is provided for receiving ink drops bursting from a printhead 42 for maintenance purpose. The waste ink tray 66 is in the shape of a tray corresponding to the area of nozzles of the printhead 42, and in its internal space, an ink absorber is filled. The ink absorber absorbs and keeps the ink drops burst from the printhead 42. When any ink in the area of the nozzles is wiped out after purging, for example, there is a possibility of slight mixture of wrong ink at the respective nozzle ports, or abnormal meniscus of the ink at the respective nozzle ports. For prevention thereof, the ink drops are burst from all of the nozzle ports of the printhead 42 after purging, thereby ejecting any mixed ink or restoring the meniscus at the respective nozzle ports to the normal state. In this specification, such bursting motion of the ink drops is referred to as flushing.

Transfer Roller Pair 59

A transfer roller pair 59 is provided on the upstream side than the platen 43 in a transfer direction 124 of the printing paper 50. The transfer roller pair 59 is configured by a transfer roller 60 and a pinch roller 61. The transfer roller 60 is disposed on the upper side of the transfer path 19, and is rotated in response to the driving force coming from an LF motor 85 which is an example of a driving source (shown in FIG. 6). The pinch roller 61 is disposed, to be able to freely rotate, on the lower side of the transfer roller 60 with the transfer path 19 sandwiched therebetween, and is biased by a spring toward the transfer roller 60.

Sheet Ejection Roller Pair 64

A sheet ejection roller pair 64 is provided on the downstream side than the platen 43 in the transfer direction 124 of the printing paper 50. The sheet ejection roller pair 64 is configured by a sheet ejection roller 62 and a spur 63. The sheet ejection roller 62 is disposed on the lower side of the transfer path 19, and is rotated in response to the driving force coming from the LF motor 85 (shown in FIG. 6). The spur 63 is disposed, to be able to freely rotate, on the upper side of the sheet ejection roller 62 with the transfer path 19 sandwiched therebetween, and is biased by a spring toward the sheet ejection roller 62.

Encoder Disk 71, and Optical Sensor 55

As shown in FIGS. 3 to 6, the transfer roller 60 is provided with an encoder disk 71 to a shaft 76 thereof. The encoder disk 71 is shaped like a transparent disk, and is marked at a predetermined pitch in the circumferential direction for light shielding. Such an encoding disk 71 is fixed to the shaft 76 of the transfer roller 60, and rotates together with the transfer roller 60. The optical sensor 55 is configured by light-emitting elements and light-receiving elements, which are disposed to oppose to one another at predetermined intervals in the cross direction 121. The optical sensor 55 is so disposed that the peripheral edge of the encoder disk 71 is located in the space between the light-emitting elements and the light-receiving elements. When the light-receiving elements of the optical sensor 55 receive light, the optical sensor 55 generates an electric signal of the level corresponding to the intensity of the received light. In the state with a mark between the light-emitting elements and the light-receiving elements, the resulting electric signal will be of LOW level, and in the state with no mark therebetween, the resulting electric signal will be of HI level. That is, every time the optical sensor 55 detects a mark of the encoder disk 71, a pulse signal is generated. Thus generated pulse signal is output to a control section 100. With the encoder disk 71 and the optical sensor 55 as such, a first sensor is implemented.

Printing Section 40

As shown in FIGS. 2 to 4, the printing section 40 is disposed on the upper side of the platen 43 to oppose the platen 43 with a predetermined distance therefrom. That is, the printing section 40 is disposed on the downstream side than the transfer roller pair 59 in the transfer direction 124. The printing section 40 is provided with the ink-jet printhead 42, and a carriage 41.

Carriage 41

As shown in FIG. 4, the carriage 41 is in the rectangular parallelepiped shape. This carriage 41 is mounted with the printhead 42, and the printhead 42 is exposed to the lower surface side. The carriage 41 is configured to be able to move in the cross direction 121 along guide frames 44 and 45 that will be described later. In the carriage 41, as for two side surfaces of the carriage 41 opposing to each other in the cross direction 121, on the side surface opposing the transmission gear 77 (shown in FIG. 3), an abutting section 53 is provided to project in the cross direction 121. This abutting section 53 can come in contact with an object 91 (shown in FIGS. 7A to 7C) of a sensing member 90 (an example of a reference member) that will be described later.

Guide Frames 44 and 45

As shown in FIGS. 3 and 4, on the upper side of the transfer path 19, a pair of guide frames 44 and 45 are disposed with a predetermined distance therebetween in the transfer direction 124. These guide frames 44 and 45 are so disposed as to extend in the cross direction 121. The guide frame 44 is provided on the upstream side than the guide frame 45 in the transfer direction 124. The carriage 41 is provided to the guide frames 44 and 45 in such a manner as to lay thereacross. With such a configuration, the carriage 41 is opposing the platen 43 with the transfer path 19 sandwiched therebetween. Note that, in FIG. 2, the guide frames 44 and 45 are not shown.

As for the carriage 41, one end portion thereof on the upstream side in the transfer direction 124 is supported by the upper surface of the guide frame 44 to be able to freely slide. Also as for the carriage 41, one end portion thereof on the downstream side in the transfer direction 124 is supported by the upper surface of the guide frame 45 to be able to freely slide. An end portion 39 of the guide frame 45 is formed by bending upward a part of the guide frame 45 in the direction of substantially right angles, and is extended in the cross direction 121. Such an end portion 39 is pinched by the carriage 41 using a resin member with a high sliding characteristic or others that are not shown. This accordingly allows the carriage 41 to move in the cross direction 121 relative to the end portion 39.

Belt Drive Mechanism 46

As shown in FIGS. 3 and 4, a belt drive mechanism 46 is disposed on the upper surface of the guide frame 45. This belt drive mechanism 46 is configured by a drive pulley 47, a follower pulley 48, and a belt 49. The drive pulley 47 and the follower pulley 48 are respectively provided in the vicinity of the ends of the belt drive mechanism 46 in the cross direction 121. The belt 49 is shaped like an endless ring with teeth provided inside, and is placed across the drive pulley 47 and the follower pulley 48.

The shaft of the drive pulley 47 is connected with a CR motor 86 (shown in FIG. 4). The drive pulley 47 rotates in response to the driving force of the CR motor 86. The rotation force of this drive pulley 47 moves the belt 49 to circulate. As is fixed to this belt 49, the carriage 41 is moved in the cross direction 121 in response to the circular movement of the belt 49.

Encoder Strip 51, and Optical Sensor 52

As shown in FIGS. 3 and 4, the guide frame 45 is provided with an encoder strip 51. The encoder strip 51 is placed across the movement range of the carriage 41 in the cross direction 121. The encoder strip 51 is shaped like a band made of transparent resin. The encoder strip 51 is marked with a pattern in which a light shielding section for light shielding and a light transmission section for light transmission are arranged alternately at a constant pitch. The carriage 41 is mounted with an optical sensor 52 for detection of such a pattern of the encoder strip 51.

The optical sensor 52 is configured by light-emitting elements and light-receiving elements, which are disposed to oppose to one another with a predetermined distance therebetween in a depth direction 123. The optical sensor 52 is so disposed that the encoder strip 51 is located in the space between the light-emitting elements and the light-receiving elements. When the light-receiving elements of the optical sensor 52 receive light, the optical sensor 52 generates an electric signal of the level corresponding to the intensity of the received light. In the state with a mark between the light-emitting elements and the light-receiving elements, the resulting electric signal will be of LOW level, and in the state with no mark therebetween, the resulting electric signal will be of HI level. That is, every time the optical sensor 52 detects a mark of the encoder strip 51, a pulse signal is generated. Thus generated pulse signal is output to the control section 100.

Printhead 42

As shown in FIGS. 2 and 4, as for the printhead 42, a nozzle section is exposed from the lower surface of the carriage 41. The nozzle section includes a large number of nozzles, which are arranged both in the cross and depth directions 121 and 123. Such a printhead 42 is provided with a supply of ink from an ink cartridge (not shown) provided inside of the printer section 11. Every time the printing paper 50 stops moving on the platen 43 due to the intermittent movement of the transfer roller 60 and the sheet ejection roller 62, the carriage 41 is moved in the cross direction 121. Together with the carriage 41 moving as such, the printhead 42 is also moved in the cross direction, and during such a movement, very small ink drops are burst selectively from the nozzles of the printhead 42 toward the printing paper 50 on the platen 43. Thereafter, by the transfer roller pair 59 and the sheet ejection roller pair 64, the printing paper 50 is transferred in the transfer direction 124 by the amount equal to a predetermined line-feed width. By alternately repeating such intermittent transfer of the printing paper 50 and the movement of the carriage 41, the printhead 42 performs image printing on the printing paper 50.

As shown in FIG. 2, the carriage 41 is provided with a sheet detection sensor 32 (an example of a second sensor). The sheet detection sensor 32 is exposed from the lower surface of the carriage 41, and is disposed on the upstream side than the printhead 42 in the transfer direction 124. The sheet detection sensor 32 is an optical sensor of a reflective type. Although not shown in detail in FIG. 2, the sheet detection sensor 32 is provided with light-emitting elements and light-receiving elements. From these light-emitting elements, light is directed downward in a height direction 122, and the light-receiving elements receive the reflected light coming from the height direction 122 of the sheet detection sensor 32. The sheet detection sensor 32 then outputs an electric signal corresponding to the light-receiving level of the light-receiving elements. It means that the sheet detection sensor 32 outputs an electric signal corresponding to the intensity of the reflective light under the illumination light of a fixed level of intensity, i.e., an electric signal corresponding to the reflectivity of an area opposing the sheet detection sensor 32. This reflectivity corresponds to a physical quantity, and the sheet detection sensor 32 corresponds to a second sensor.

LF Motor 85

Figure 6:
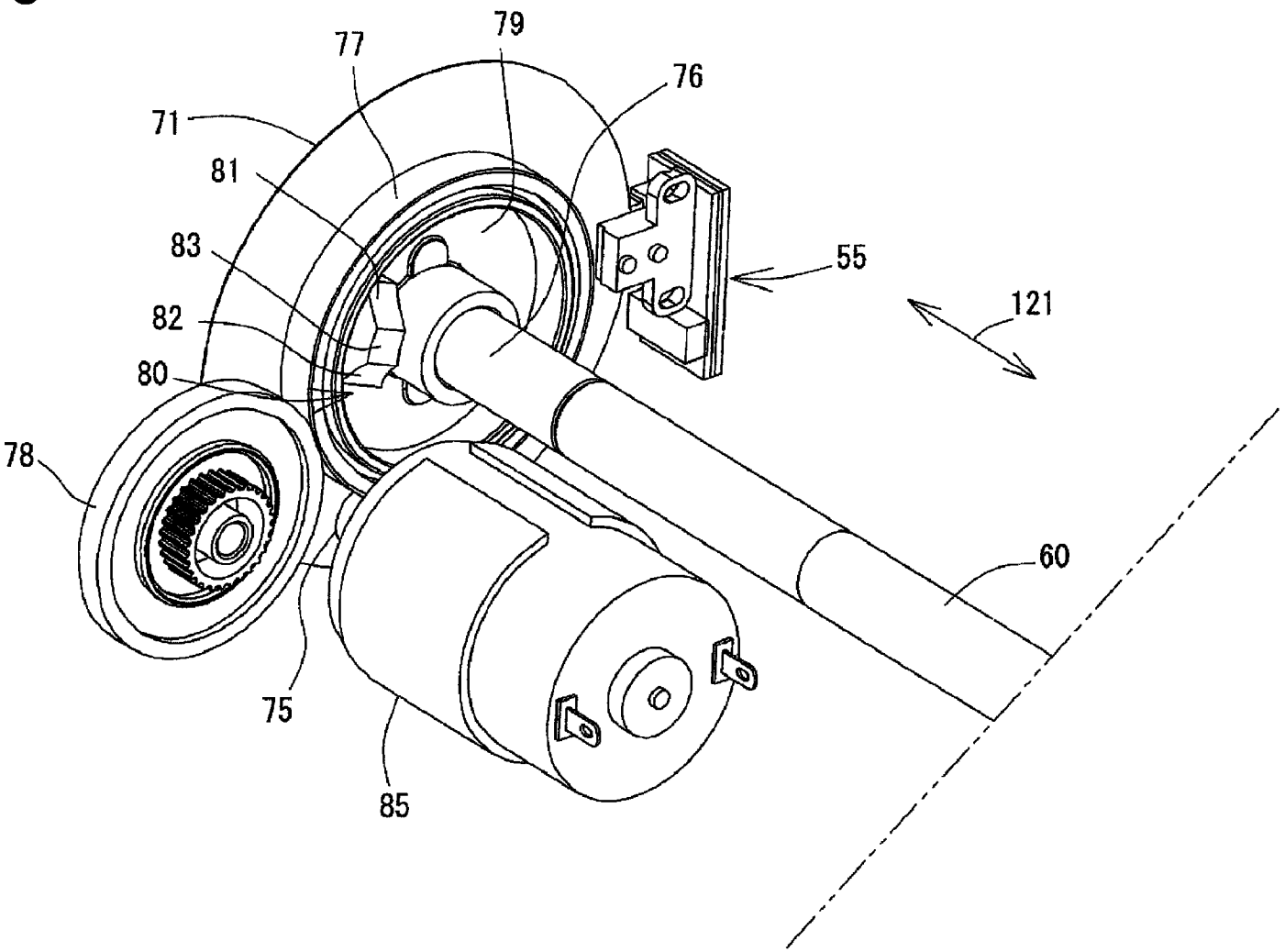
FIG. 6 is an enlarged perspective view of the transmission gear and therearound, showing the configuration thereof.

As shown in FIG. 6, the printer section 11 is provided with the LF motor 85. The LF motor 85 serves to rotate the transfer roller 60 and the sheet ejection roller 62 with rotation control thereover. Such an LF motor 85 is exemplified by a DC (Direct-Current) motor. This LF motor 85 corresponds to a driving source.

In the LF motor 85, an output shaft 75 is formed with dents on the outer periphery thereof, and is engaged with the transmission gear 77. The transmission gear 77 is a spur gear, and is coaxially coupled to the shaft 76 of the transfer roller 60, thereby rotating in conjunction with the shaft 76. With such a transfer gear 77, the rotation of the LF motor 85 is transmitted to the shaft 76 of the transfer roller 60. This transmission gear 77 corresponds to a drive transmission mechanism.

The transmission gear 77 is being engaged with a transmission gear 78. This transmission gear 78 is also coupled with another transmission gear (not shown) in series, and is eventually coupled to the shaft of the sheet ejection roller 62. The rotation of the LF motor 85 is transmitted also to the shaft of the sheet ejection roller 62 so that the transfer roller 60 and the sheet ejection roller 62 rotate in conjunction with each other.

The transfer roller 60 and the sheet ejection roller 62 are driven intermittently by the LF motor 85 at the time of image printing by the printing section 40. The expression of "driven intermittently" herein means a driving mode with which the LF motor 85 is repeatedly driven and stopped, i.e., the LF motor 85 is continuously driven until the transfer roller 60 and the sheet ejection roller 62 are rotated by the rotation amount corresponding to a predetermined target transfer amount, and when the rollers are rotated by the target transfer amount, the LF motor 85 is then stopped for a predetermined length of time.

When the printing paper 50 provided to the transfer path 19 reaches the area between the transfer roller 60 and the pinch roller 61, the printing paper 50 is directed onto the platen 43 by the rotation force of the transfer roller 60 while being sandwiched between the transfer roller 60 and the pinch roller 61. When such a printing paper 50 then reaches the area between the sheet ejection roller 62 and the spur 63, the printing paper 50 is directed above the sheet feeding cassette 22 by the rotation force of the sheet ejection roller 62 while being sandwiched between the sheet ejection roller 62 and the spur 63.

As such, the printing paper 50 is transferred over the platen 43 by the rotation force of at least either the transfer roller 60 or the sheet ejection roller 62. During the transfer as such, because the transfer roller 60 and the sheet ejection roller 62 are driven intermittently, the printing paper 50 is transferred also intermittently along the transfer path 19. Thereafter, when the printing paper 50 is stopped moving on the platen 43 during such intermittent transfer, the printing section 40 performs image printing thereon.

Note here that when the printing section 40 does not perform image printing, there is no need for the transfer roller 60 and the sheet ejection roller 62 to be driven intermittently. Accordingly, before the printhead 42 starts to operate for image printing, and after the completion of the printing operation, the transfer roller 60 and the sheet ejection roller 62 are rotated in sequence.

Transmission Gear 77

As shown in FIGS. 5 and 6, in the transmission gear 77, a surface 79 facing the side of the carriage 41 is provided with a protrusion 80. This protrusion 80 is placed in a predetermined rotation phase of the transmission gear 77, and projects from the surface 79 in the cross direction 121 being the movement direction of the carriage 41. The protrusion 80 is configured to include inclined surfaces 81 and 82, and a surface 83. The inclined surfaces 81 and 82 each form a predetermined inclined angle with respect to the surface 79, and the surface 83 is disposed between the inclined surfaces 81 and 82 to be parallel to the surface 79. These inclined surfaces 81 and 82 are those inclined substantially along the circumferential direction of the transmission gear 77.

Sensing Member 90

As shown in FIG. 5, the sensing member 90 (an example of reference member) is disposed in the vicinity of an end portion of the platen 43 where the transmission gear 77 is disposed thereon. This sensing member 90 is operated by the protrusion 80 provided to the transmission gear 77.

Figure 7A:
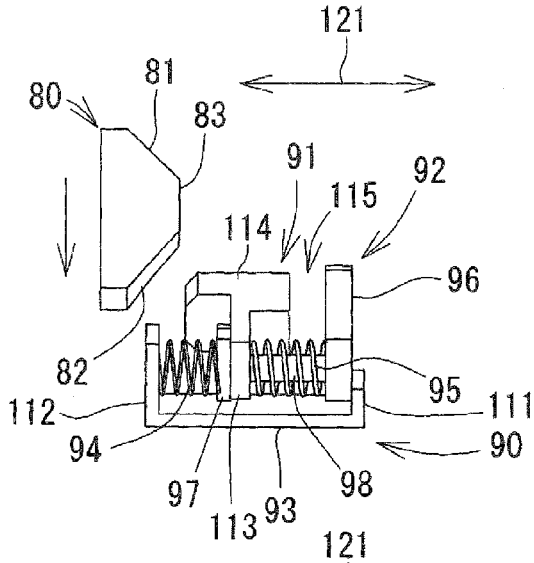
FIGS. 7A to 7C are each a plan view of a reference member, showing the configuration thereof.
Figure 7B:
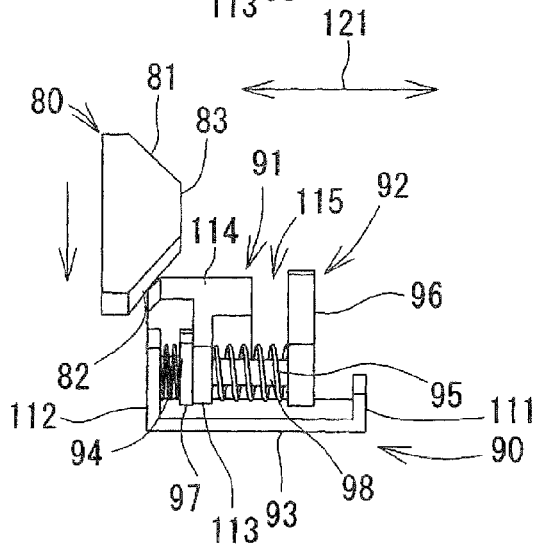
Figure 7C:
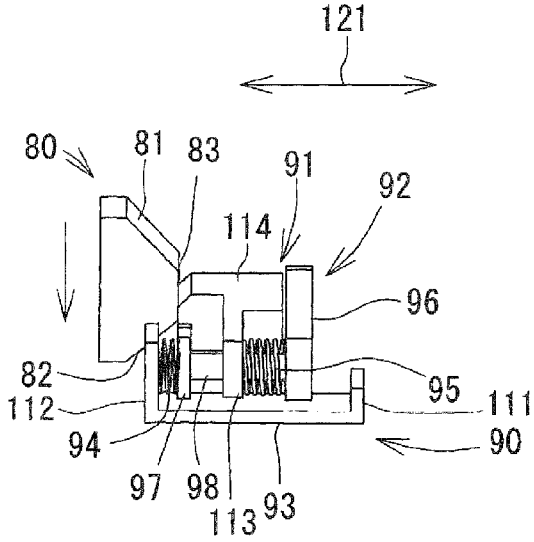

As shown in FIGS. 7A to 7C, the sensing member 90 is configured mainly by the object 91, a lever 92, a supporting member 93, and coil springs 94 and 95. The supporting member 93 is fixed on the upper surface of the platen 43. Such a supporting member 93 is incorporated with the object 91 and the lever 92 to be able to slide in the cross direction 121. The supporting member 93 is provided with walls 111 and 112, which are disposed with a distance therebetween in the cross direction 121. The object 91 and the lever 92 are allowed to slide in the cross direction 121 as such between the walls 111 and 112.

The lever 92 is configured by first and second abutting pieces 96 and 97, which are coupled together by a shaft 98. The first and second abutting pieces 96 and 97 are disposed with a distance therebetween in the cross direction 121, and the shaft 98 extends along the cross direction 121. This shaft 98 is coupled with, at its both ends, the first and second abutting pieces 96 and 97, respectively. The first and second abutting pieces 96 and 97 are so disposed that the second abutting piece 97 is located on the side of the transmission gear 77. In a range where the lever 92 is moved to slide in the cross direction 121, the first abutting piece 96 is allowed to come in contact with the wall 111 of the supporting member 93. The position where the first abutting piece 96 comes in contact with the wall 111 of the supporting member 93 as such is the end of the range where the first abutting piece 96 is allowed to slide toward the center in the cross direction 121, i.e., on the right side in FIGS. 3 and 7A to 7C. Between the second abutting piece 97 and the wall 112 of the supporting member 93, the coil spring 94 is provided. The second abutting piece 97 and the wall 112 each serve as a spring seat of the coil spring 94. The coil spring 94 is disposed between the second abutting piece 97 and the wall 112 of the supporting member 93, and is compressed therebetween. By such a coil spring 94, the lever 92 is biased toward the center in the cross direction 121.

The object 91 is incorporated to the shaft 98 of the lever 92, thereby being allowed to slide in the cross direction 121. More in detail, the object 91 is configured to include a supporting section 113 and a detecting portion 114, and is shaped like a letter T in a planar view. The supporting section 113 is provided to the shaft 98 to be able to freely slide, and the detecting portion 114 is extended from the supporting section 113 in the cross direction 121. The supporting section 113 is formed with a through hole (not shown) that goes through in a thickness direction, i.e., cross direction 121. Through this through hole, the shaft 98 is inserted so that the supporting section 113 is incorporated to the shaft 98 to be able to freely slide. The supporting section 113 is projected from the shaft 98 in the diameter direction, and is shaped like a flat plate extending along the transfer and height directions 124 and 122.

The supporting section 113 is coupled with the detecting portion 114 at the extended end thereof. The detecting portion 114 is projected from the extended end of the supporting section 113 toward the both sides in the cross direction 121, and is shaped like a flat plate extending in both the cross and height directions 121 and 122. The detecting portion 114 is so configured as to have a reflectivity different from that of the upper surface of the platen 43. This is for the detecting portion 114 to output an electric signal of varying level between when the sheet detection sensor 32 is opposing the detecting portion 114, and when it is opposing the upper surface of the platen 43. Such a difference of reflectivity is implemented by a different surface roughness between the detecting portion 114 and the upper surface of the platen 43, a different face angle therebetween, a different surface material therebetween, or others. In this embodiment, such a difference of reflectivity is achieved by different coloring between the detecting portion 114 and the upper surface of the platen 43. More specifically, the upper surface of the platen 43 is colored black, and the detecting portion 114 is colored white.

The coil spring 95 is disposed between the first abutting piece 96 of the lever 92 and the supporting section 113 of the object 91. This coil spring 95 is externally wound around the shaft 98. The first abutting piece 96 and the supporting section 113 each serve as a spring seat of the coil spring 95. The coil spring 95 is disposed between the first abutting piece 96 and the supporting section 113, and is compressed. By such a coil spring 95, the object 91 is biased toward the outside in the cross direction 121, i.e., on the side of the transmission gear 77: on the left side in FIGS. 3 and 7A to 7C.

As shown in FIG. 7A, when the sensing member 90 is free from any external force, the lever 92 is moved to slide toward the center in the cross direction 121 by being biased by the coil spring 94 so that the first abutting piece 96 comes in contact with the wall 111 of the supporting member 93. Moreover, the object 91 is moved to slide toward the outside in the cross direction 121 by being biased by the coil spring 95 so that the supporting section 113 comes in contact with the second abutting piece 97 of the lever 92. Also in this state, between the detecting portion 114 of the object 91 and the first abutting piece 96 of the lever 92, a space 115 is formed.

As shown in FIG. 7B, when the carriage 41 is moved to the end position, i.e., the position shown in FIG. 3, the abutting section 53 of the carriage 41 comes in contact with the first abutting piece 96 of the lever 92 so that the first abutting piece 96 is moved to slide to the outside in the cross direction 121, i.e., on the left side in FIGS. 7A to 7C, against the biasing force of the coil spring 94. In response to the sliding movement of the lever 92 as such, the object 91 is also moved to slide to the outside in the cross direction 121 together with the lever 92. In this state with the space 115 remained intact, in the carriage 41 located on the end position, the position to be detected by the sheet detection sensor 32 mounted to such a carriage 41 corresponds to the space 115. That is, the sheet detection sensor 32 detects any light reflected by the upper surface of the platen 43 via the space 115.

As shown in FIG. 7C, when the protrusion 80 of the transmission gear 77 comes in contact with the detecting portion 114 of the object 91, against the biasing force of the coil spring 95, the detecting portion 114 is moved to slide toward the center in the cross direction 121, i.e., on the right side in FIGS. 7A to 7C, along the inclined surface 81 of the protrusion 80. When the surface 83 of the protrusion 80 comes in contact with the detecting portion 114, the space 115 is accordingly closed. In such a state with the closed space 115, in the carriage 41 on the end position, the position to be detected by the sheet detection sensor 32 mounted to such a carriage 41 corresponds to the detecting portion 114. That is, the sheet detection sensor 32 detects the light reflected by the detecting portion 114.

Control Section 100

Figure 8:
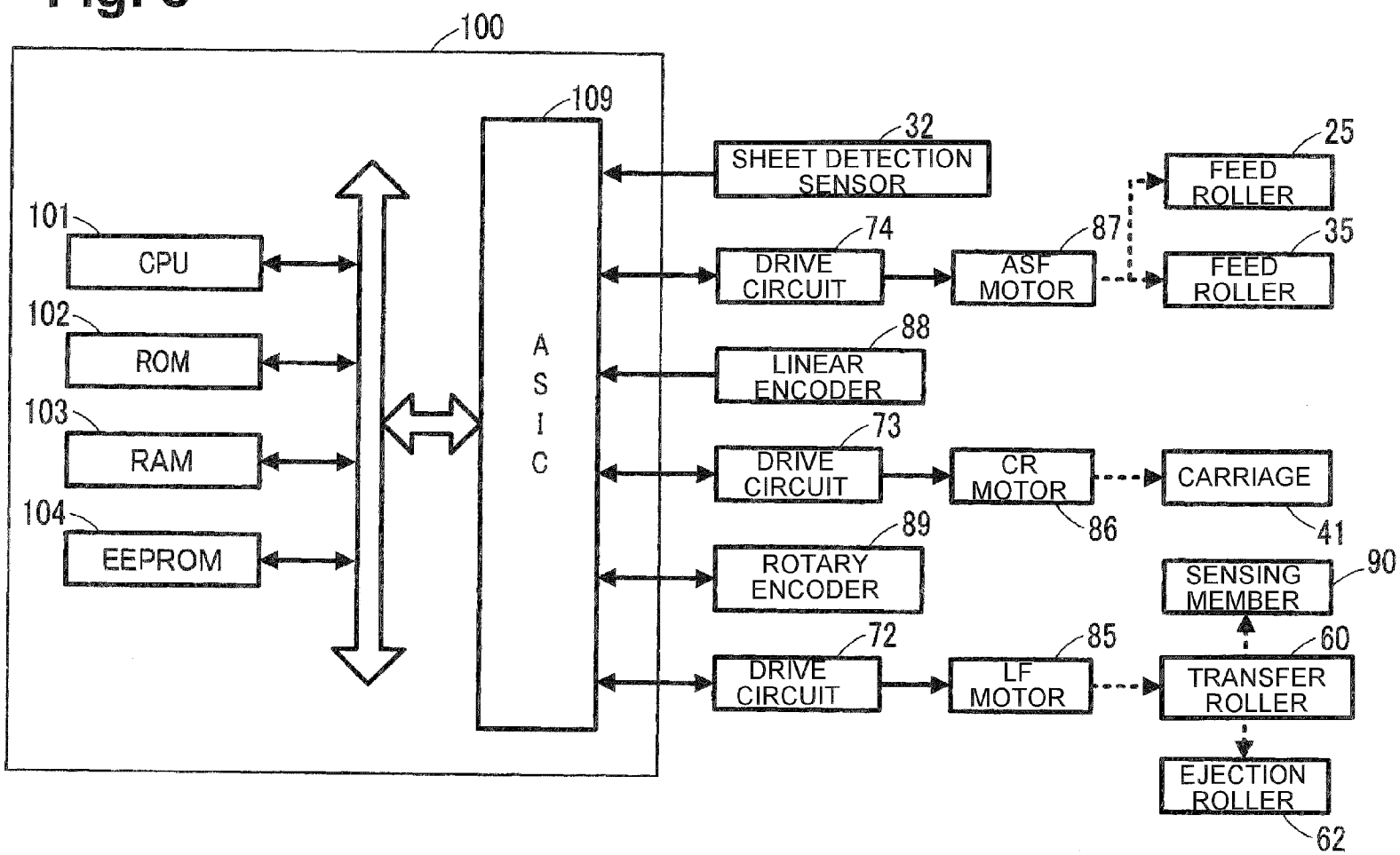
FIG. 8 is a block diagram showing the configuration of a control section.

The control section 100 of FIG. 8 is in charge of controlling not only the printer section 11 but also entirely over the multifunctional device 10. The control section 100 is configured as a microcomputer, mainly including a CPU (Central Processing Unit) 101, a ROM (Read-Only Memory) 102, a RAM (Random-Access Memory) 103, EEPROM (Electrically Erasable Programmable ROM) 104, and an ASIC (Application Specific Integrated Circuit) 109. Such a control section 100 serves as printing section detection means, origin determining section, correction section, and control section. Note that, in FIG. 8, transmission paths for a driving force coming from motors 85, 86, and 87 are each indicated by broken lines.

The ROM 102 stores therein a program for the CPU 101 to control the motors 85, 86, and 87, and the multifunctional device 10, for example. The RAM 103 is used as a storage area or a working area by the CPU 101, i.e., a storage area for a temporary storage of various types of data for use by the CPU 101 to run the above-described program, and a working area for data processing or others. Such a RAM 103 stores therein a current rotation phase of the transfer roller 60 (hereinafter, referred to as "current phase θ"). This current phase θ is updated as appropriate in response to every rotation of the transfer roller 60. The EEPROM 104 stores therein the setting details, flags, and others, which are those needed to be stored even after the power is turned off. This EEPROM 104 also stores therein a correction value function A(θ), which will be described later. This correction value function A(θ) defines the correlation between the current phase θ of the transfer roller 60 and a correction value related to the printing paper 50, i.e., the transfer amount thereof per rotation amount of the transfer roller 60. The correction value function A(θ) is with the correlation returning a correction value through substitution of a variable θ. Such a correction function may be stored in the form of a table, or may be stored by following a rule such as polynomial or others. When the correction function is stored by following polynomial, the polynomial may be stored in the ROM 102, and only coefficients of the respective factors of the polynomial may be stored in the EEPROM 104.

The ASIC 109 is connected with the sheet detection sensor 32, driving circuits 72, 73, and 74, a linear encoder 88, and a rotary encoder 89. Herein, the control section 100 is connected with the scanner section 12, the operation panel 14, and others, but such a connection is not limited to the embodiment described here.

The driving circuit 72 is for driving the LF motor 85. The LF motor 85 is coupled with the shaft 76 of the transfer roller 60, and the shaft of the sheet ejection roller 62 via the transmission gears 77 and 78, and others. The driving circuit 72 drives the LF motor 85 in response to an output signal coming from the ASIC 109. The driving force of the LF motor 85 is transmitted to the shaft 76 or others, and in response thereto, the transfer roller 60 and the sheet ejection roller 62 start rotating synchronously. After reaching the transfer path 19, the printing paper 50 is moved therealong by the rotation force of the transfer roller 60 or that of the sheet ejection roller 62, and then is ejected onto the upper surface 23 of the sheet feeding cassette 22. The transfer roller 60 is coupled with the sensing member 90 via the transmission gear 77. When the transfer roller 60 is rotated, in conjunction therewith, the object 91 of the sensing member 90 is moved to slide in the cross direction 121.

The driving circuit 73 is operated to drive the CR motor 86 in response to an output signal from the ASIC 109. The driving force of the CR motor 86 is transmitted to the carriage 41 via the belt drive mechanism 46 so that the carriage 41 is moved in the cross direction 121.

The driving circuit 74 is for driving the ASF motor 87. The ASF motor 87 is coupled with the sheet feeding roller 25 or 35 via the drive transmission mechanism that is not shown. The driving circuit 74 is operated to rotate the ASF motor 87 in response to an output signal coming from the ASIC 109. The drive transmission mechanism then transmits the driving force of the ASF motor 87 selectively to the sheet feeding roller 25 or 35. The printing paper 50 located at the top in the sheet feeding cassette 21 or 22 is directed to the transfer paths 18 and 19 by the rotation force of the sheet feeding roller 25 or 35.

The sheet detection sensor 32 outputs an analog electric signal (voltage signal or current signal) corresponding to the amount of light received by the light-receiving elements. When the signal coming from the sheet detection sensor 32 as such is of an electric level (voltage or current value) equal to or higher than a predetermined threshold value, the control section 100 determines that the signal is HI in level, and is LOW in level when such a level is smaller than the predetermined threshold value. In this embodiment, the signal coming from the sheet detection sensor 32 is determined as HI in level when the receiving light is the one reflected by the printing paper 50 in the color of white or by the detecting portion 114 of the sensor 90, and is determined as LOW in level when the receiving light is the one reflected by the upper surface of the platen 43 in the color of black.

The linear encoder 88 is for detecting the pattern of the encoder strip 51 using the optical sensor 52 mounted to the carriage 41, and for outputting a pulse signal. Based on the pulse signal to be output as such, the control section 100 determines the speed and position of the carriage 41, thereby controlling the driving of the CR motor 86.

The rotary encoder 89 is operated to detect the marks on the encoder disk 71 using the optical sensor 55, and output a pulse signal. Based on the pulse signal to be output as such, the control section 100 determines the rotation amount of the transfer roller 60, thereby controlling the driving of the LF motor 85.

Herein, for achieving the transfer of the printing paper 50 in the printer section 11 with high accuracy, preferably, the rotation amount of the transfer roller 60 to be detected by the rotary encoder 89 has the linearity with the actual transfer amount of the printing paper 50 by the transfer roller 60. When there is no slip between the transfer roller 60 and the printing paper 50, the transfer amount of the printing paper 50 shows a match with the movement amount of the transfer roller 60 on the surface. However, because the movement amount of a rotation body on the surface is the product of the rotation radius and the rotation angle, if the rotation radius of the transfer roller 60 varies, the transfer amount of the printing paper 50 resultantly varies. This is applicable also to the sheet ejection roller 62.

Figure 9A:
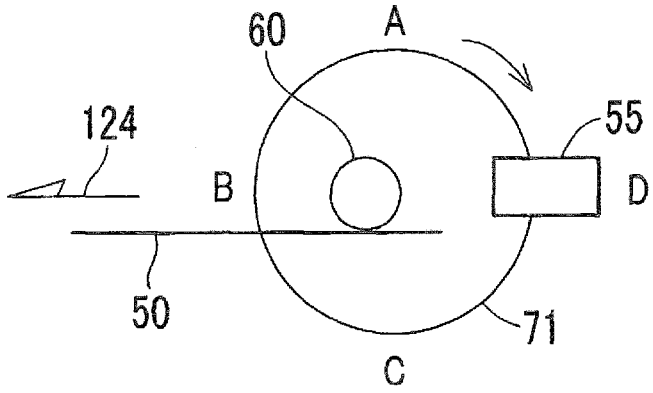
FIGS. 9A and 9B are each a diagram for illustrating the cyclic variation observed in the transfer amount of a printing paper, and specifically.
Figure 9B:
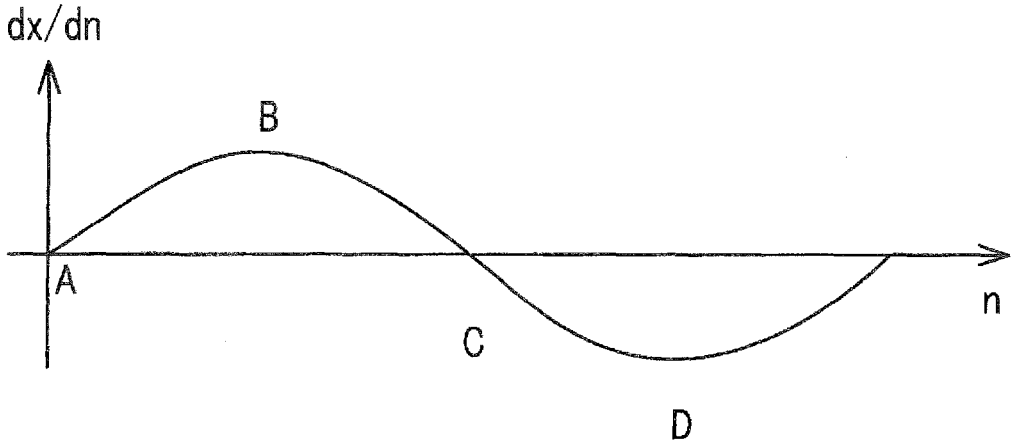

FIG. 9A shows the transfer roller 60 whose shaft 76 is attached with the eccentric encoder disk 71. With such eccentricity of the encoder disk 71 or any other factors, the transfer amount of the printing paper 50 by the transfer roller 60 to be detected by the rotary encoder 89 per rotation amount shows a variation on a cycle basis (shown in FIG. 9B). The other factors include the warping of the transfer roller 60, the uneven thickness of coating, the eccentricity of the transmission gear 77 engaged to the shaft 76 of the transfer roller 60, and others. The cycle herein is a rotation of the transfer roller 60. In the example of FIGS. 9A and 9B, when the encoder disk 71 is detected as being on a position B, the transfer amount of the printing paper 50 is high per pulse signal coming from the rotary encoder 89. Conversely, when the encoder disk 71 is detected as being on a position D, the transfer amount of the printing paper 50 is low per pulse signal coming from the rotary encoder 89. As such, the transfer amount of the printing paper 50 by the transfer roller 60 varies on a cycle basis.

As such, for reducing such a cyclic variation of the transfer amount by the transfer roller 60, the control section 100 controls the driving of the LF motor 85 to correctly make uniform the transfer amount of the printing paper 50 by the transfer roller 60. The EEPROM 104 stores therein the correction value function A(θ) for use with such a correction process for the rotation amount by the transfer roller 60. Described below is the process of acquiring the correction value function A(θ). Note here that this correction value function A(θ) is acquired before the shipment of the multifunctional device 10, and is written in advance into the EEPROM 104. Alternatively, the correction value function A(θ) may be written into the EEPROM 104 by a user executing a predetermined operation with instructions found in a manual or displayed on the operation panel 14 at the time of starting to use the multifunctional device 10.

Acquisition of Correction Value Function A(θ)

In this embodiment, the transfer roller 60 is so configured that the printing paper 50 is moved forward by 1.2 inches with a rotation of the transfer roller 60. The printhead 42 has the resolution of 150 dpi (dot per inch) for the nozzles in the transfer direction 124. This means that the nozzles are arranged at uniform intervals of 1/150 inches. With a rotation of the encoder disk 71, 8640 pulse signals are to be output from the rotary encoder 89.

The control section 100 controls the driving of the ASF motor 87, thereby directing the printing paper 50 from the sheet feeding cassette 21 or 22 to the transfer path 19. The control section 100 also controls the operation of the printing section 40, thereby making the printing section 40 to record, on the tip end side of the printing paper 50, a line extending long in the cross direction 121 (shown in FIG. 10A). To be more specific, the control section 100 moves the carriage 41 from one end side to the other end side in the cross direction 121 by a first distance, and at the same time, bursts the ink from the nozzle located on the most upstream in the transfer direction 124 of the printhead 42, i.e., first nozzle. As such, when a long line is drawn on the printing paper 50 at its tip end side, the control section 100 controls the driving of the LF motor 85, thereby moving forward the printing paper 50 by the amount of a pulse signal, i.e., 0.57 inches. More specifically, the control section 100 keeps driving the LF motor 85 until 4104 (=8640/1.2×0.57) pulse signals are provided by the rotary encoder 89 to make the transfer roller 60 to move the printing paper 50. The LF motor 85 is stopped after the number of the pulse signals provided by the rotary encoder 89 reaches 4104.

Figure 10A:
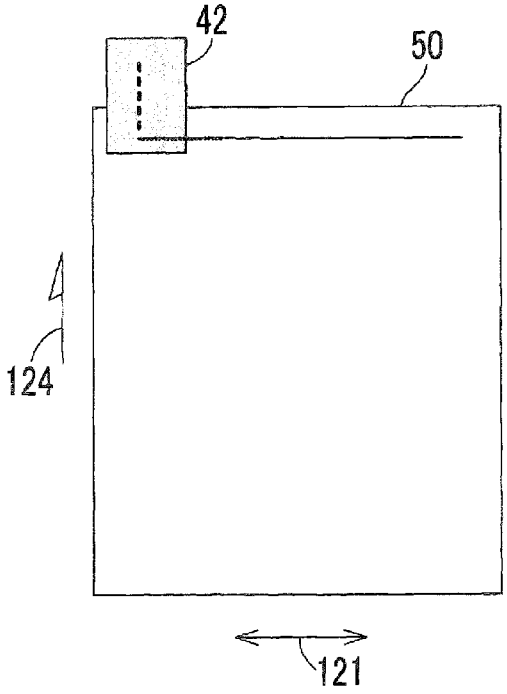
FIGS. 10A to 10D are each a diagram for illustrating a process for acquisition of a correction value function A(θ)
Figure 10B:
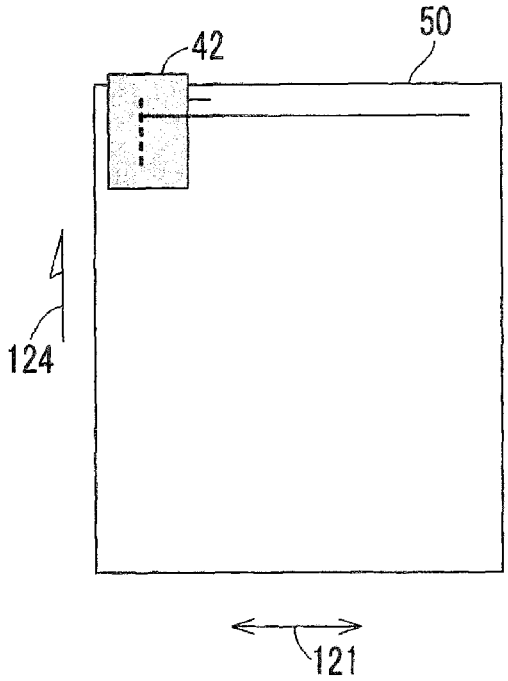
Figure 10C:
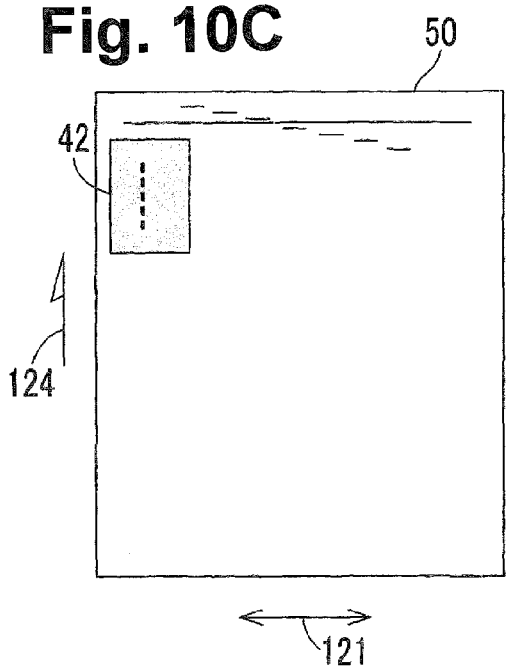

Next, the control section 100 makes the printing section 40 to record, on the printing paper 50, a short line extending in the cross direction 121 (shown in FIG. 10B). More specifically, the control section 100 moves the carriage 41 from one end side to the other end side in the cross direction 121 by a second distance shorter than the first distance, and at the same time, bursts the ink from the nozzle positioned 91st from the most upstream side in the transfer direction 124 of the printhead 42, i.e., 91st nozzle. Because the printhead 42 has the resolution of 150 dpi for the nozzles in the transfer direction 124, the distance between the first and 91st nozzles in the transfer direction 124 is 0.6 (=(91−1)/150) inches. It means, ideally, the 91st nozzle is away from the long line by 0.03 (=0.6−0.57) inches in the transfer direction 124.

The control section 100 alternately repeats the operation of making the printing section 40 to draw a short line, and the operation of making the LF motor 85 to move forward the printing paper 50 by the amount of a pulse signal (8640/1.2×0.01), i.e., 0.01 inches. This accordingly records seven short lines on the printing paper 50 (shown in FIG. 10C). Note here that the printhead 42 performs the printing operation while changing the position of the carriage 41 in the cross direction 121 to vary the positions of these seven short lines in the cross direction 121.

Figure 10D:
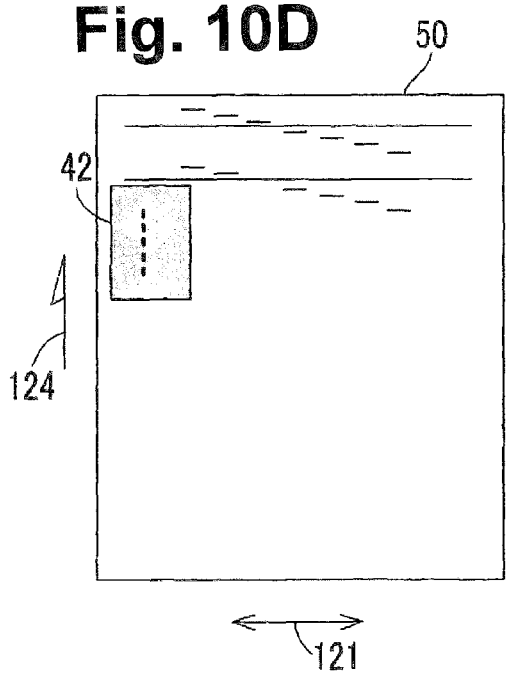

The control section 100 then repeats the process of printing another long line at the position ahead from the lastly-recorded long line by 0.1 inches, and printing seven short lines with respect to the resulting long line (shown in FIG. 10D). By repeating such a process of printing a long line and seven short lines as a pattern, twelve patterns in total are recorded on the printing paper 50 (FIG. 11(A)). Note that, for forming a pattern by transferring the printing paper 50 always in the same direction, the printing order of the long and short lines may be reversed from the one described above. For forming a pattern by transferring the printing paper 50 always in the same direction, a second long line to be recorded at the position ahead from a first long line by 0.1 inch is recorded earlier than a first short line recorded for the first long line at the position ahead therefrom by 0.57 inch, for example. Such an order of pattern printing does not affect the result of an operation that will be described later for finding the correlation between the transfer amount of the printing paper 50 and the phase of the transfer roller 60. The recorded lines may serve their purposes as long as each show a predetermined relative positional relationship.

Thereafter, in the respective patterns, a determination is made which of the short lines coincides best with the long line, or if the long line falls between the short lines, which two of the short lines coincides best with the long line. More in detail, the printing paper 50 is placed on the contact glass of the scanner section 12, and the scanner section 12 is operated to perform image reading of the printing paper 50. The control section 100 then determines which of the short lines coincides best with the long line, or if the long line falls between the short lines, which two of the short lines coincides best with the long line. Such a determination process is executed to each of the patterns. Herein, assuming that the short lines drawn for each long line are numbered 1 to 7 in order from the left, if with the printing paper 50 of FIG. 11A, starting from the long line at the top in FIG. 11A, the numbers are to be 3, 2. 5, 2, 3, 4, 4, 5, 6, 6.5, 6, 4, and 3.5. Herein, when the long line falls between the two short lines, the number to be taken is an average value between the numbers of the two short lines.

The first and 91st nozzles are away from each other by 0.6 inches in the transfer direction 124. Accordingly, when the number is 4, with respect to the target transfer amount of 0.6 (=0.57+0.01×(4−1)) inches, the actual movement of the printing paper 50 is 0.6 inches. When the number is 3, with respect to the target transfer amount of 0.59 (=0.57+0.01×(3−1)) inches, the actual movement of the printing paper 50 is 0.6 inches. This indicates that the printing paper 50 is moved by the circumferential surface of the transfer roller 60 on the side of the position B of FIG. 9A. When the number is 5, with respect to the target transfer amount of 0.61 (=0.57+0.01×(5−1)) inches, the actual movement of the printing paper 50 is 0.6 inches. This indicates that the printing paper 50 is moved by the circumferential surface of the transfer roller 60 on the side of the position D of FIG. 9A.

Figure 11A:
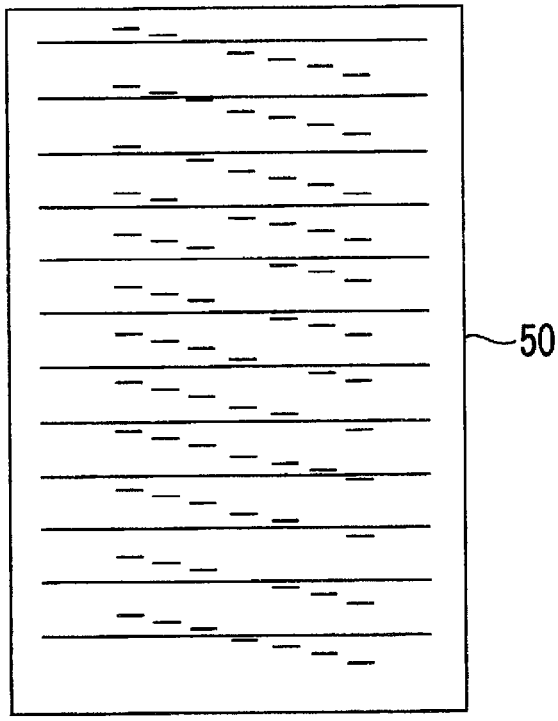
FIGS. 11A and 11B are each another diagram for illustrating the process for acquisition of the correction value function A(θ)
Figure 11B:
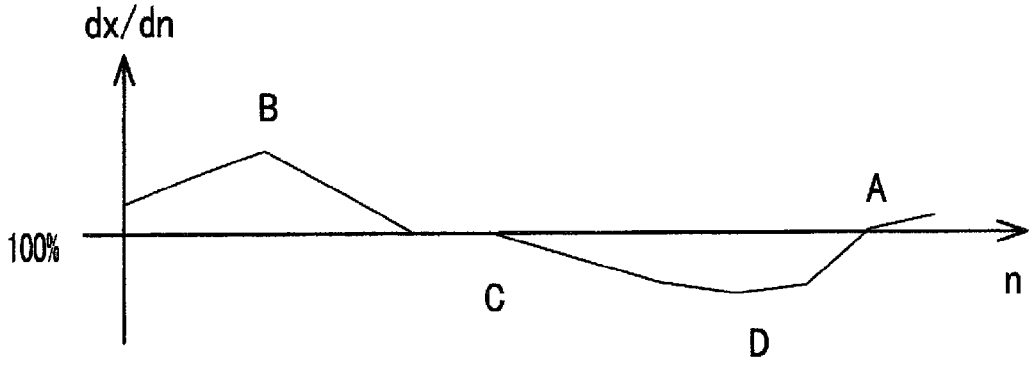

The graph of FIG. 9B can be derived by allocating the number of pulses on the lateral axis by a cycle of 1/12 (720 pulses), and by representing, in ratio, the transfer amount per the number of pulses on the vertical axis with respect to the target transfer amount (shown in FIG. 11B). That is, the resulting graph helps to keep track of how the transfer amount of the printing paper 50 is changed with respect to the target transfer amount during a rotation of the transfer roller 60.

As long as the rotary encoder 89 keeps detecting the rotation of the transfer roller 60, the rotation amount of the current encoder disk 71 can be kept track of The rotation amount here is the one with respect to the rotation phase of the encoder disk 71 when a long line of the pattern of FIG. 11A is recorded for the first time on the printing paper 50. As such, when a command comes for transferring the printing paper 50, by referring to the graph described above, an average difference may be calculated for the transfer amount of the transfer roller 60 from the current position to the position at the time of completion of the transfer, and the target transfer amount may be corrected in consideration of the influence thereof. If this is the case, any possible cyclic variation can be suppressed for the transfer amount of the printing paper 50.

Herein, the rotation phase of the encoder disk 71 when the long line is recorded for the first time is so controlled as to coincide with the position of an origin of the transfer roller 60 that will be described later, or to be at the position with a predetermined phase difference from the position of the origin. In this embodiment, the correction value function A(θ) is generated for correcting the target transfer amount of the printing paper 50 based on the graph of FIG. 11B, and the resulting function is stored in the EEPROM 104. Accordingly, even if the multifunctional device 10 is turned off and then on again, by detecting a physical starting point of the transfer roller 60, the rotation amount of the transfer roller 60 can be appropriately corrected.

Determination of Origin

By referring to the flowchart of FIG. 12, described next is the process procedure to be executed in the printer section 11 in response to when the multifunctional device 10 is turned on. Note that processes to be described below by referring to the flowchart are executed in response to a command issued by the control section 100 based on the program stored in the ROM 102.

The control section 100 determines whether or not the multifunctional device 10 is turned on based on whether a predetermined input key is operated or not on the operation panel 14 (S1). When determining that the multifunctional device 10 is not yet turned on (S1: NO), the control section 100 is put on standby. When determining that the multifunctional device 10 is turned on (S1: YES), the control section 100 drives the CR motor 86 through control over the driving circuit 73 (S2). Note that, when the multifunctional device 10 is turned off, the control section 100 moves the carriage 41 to its home position. This home position is located within a movement range of the carriage 41 to move back and forth, and is at the end opposite to the transmission gear 77, i.e., on the right side in FIG. 3. Herein, within the movement range of the carriage 41 to move back and forth, another end where the transmission gear 77 is positioned is referred to as end position, i.e., on the left side in FIG. 3. This end position is an example of a sensing position.

In response to the driving of the CR motor 86, the carriage 41 at the home position starts moving to the end position thereof. The control section 100 then determines whether or not the carriage 41 reaches the end position based on the detection result of the linear encoder 88 (S3). Until the carriage 41 reaches the end position, the CR motor 86 is continuously driven. When the carriage 41 reaches the end position (S3: YES), the control section 100 stops the driving of the CR motor 86 (S4).

When the carriage 41 is positioned on the end position, the control section 100 performs flushing (S5). Although this flushing is not necessarily performed, if the carriage 41 remains at the end position for a long time during the process procedure to be described below, the flushing is preferably performed without fail to prevent drying of the printhead 42 and clogging of the nozzles during that time.

When the carriage 41 is positioned on the end position, as shown in FIG. 7B, the abutting section 53 of the carriage 41 comes in contact with the first abutting piece 96 of the lever 92 so that the lever 92 is moved to slide. The sheet detection sensor 32 mounted to the carriage 41 thus becomes ready for detection of any light reflected by the upper surface of the platen 43 via the space 115. At the end position as such, the control section 100 turns on the sheet detection sensor 32 (S6). Herein, the sheet detection sensor 32 may be already turned on before the process of S6.

The concern here is that, when the carriage 41 is positioned on the end position as described above (S3), the surface 83 of the protrusion 80 formed to the transmission gear 77 may possibly come in contact with the object 91 of the sensing member 90. If this is the case, as shown in FIG. 7C, the space 115 will not be formed in the sensing member 90, and thus the sheet detection sensor 32 may detect the detecting portion 114. In this case, a signal coming from the sheet detection sensor 32 is determined as HI in level (S7: YES).

When determining that the signal coming from the sheet detection sensor 32 as HI in level, the control section 100 drives the LF motor 85 to rotate the transfer roller 60 by 1/N (where N is a natural number other than 1) of a rotation (S8). The control section 100 then stops the driving of the LF motor 85 (S9), and ends the flushing (S10). This accordingly stops the driving of the transmission gear 77 at a rotation position where the protrusion 80 does not come in contact with the object 91 of the sensing member 90. The rotation amount of the transfer roller 60 herein, i.e., 1/N of a rotation thereof, may be arbitrarily set as long as the number is not an integral multiple of the rotation cycle.

The control section 100 then returns the carriage 41 to the home position at one end (S11), and then positions the carriage 41 again on the end position (S3). This accordingly positions the carriage 41 on the end position with no contact of the protrusion 80 of the transmission gear 77 with the object 91 of the sensing member 90.

When determining that the signal coming from the sheet detection sensor 32 as LOW in level (S7: NO), the control section 100 drives the LF motor 85 (S12). In response to the driving of the LF motor 85, the transmission gear 77 starts rotating so that the transfer roller 60 and the sheet ejection roller 62 also start rotating. When the transmission gear 77 has a predetermined rotation phase, the protrusion 80 comes in contact with the object 91 of the sensing member 90. More in detail, either the inclined surface 81 or 82 of the protrusion 80 comes in contact with the detecting portion 114 of the object 91, and thus the transmission gear 77 is rotated to a further degree so that the detecting portion 114 of the object 91 is moved from the inclined surface 81 or 82 to the surface 83. As a result, the detecting portion 114 is moved to slide by the protrusion 80 to be pushed toward the home position, and thus the space 115 is closed (shown in FIG. 7C). Such a contact between the protrusion 80 and the object 91 of the sensing member 90 is made once every rotation of the transmission gear 77.

While the LF motor 85 is driven, the control section 100 monitors any output change of the sheet detection sensor 32. As described above, the transmission gear 77 is formed with one protrusion 80, and when the transmission gear 77 rotates once, the protrusion 80 comes in contact once with the object 91 of the sensing member 90. When the object 91 of the sensing member 90 is moved toward the home position, the space 115 is closed, and the sheet detection sensor 32 that has been receiving the reflected light from the upper surface of the platen 43 via the space 115 starts receiving the reflected light from the detecting portion 114 of the object 91. Accordingly, during a rotation of the transmission gear 77, the determination about the output from the sheet detection sensor 32 is changed from LOW to HI, and then to LOW again.

When the control section 100 detects a change from LOW to HI observed in the output from the sheet detection sensor 32, i.e., so-called "rising" of signal (S13; YES), the current phase θ of the transfer roller 60 is defined at the respective points in time (S16). Such a definition is made with the current phase θ of the rotary encoder 89 being 0 at the time of detection as such, i.e., origin, and the phase of the rotary encoder 89 thereafter from this position is accumulated. Information about the origin of this transfer roller 60 is stored in the RAM 103. Note that, in this embodiment, the setting is so made that the rising position of the signal is at the origin. This is surely not restrictive, and alternatively, any characteristic point may be used as an origin as long as the characteristic point is the one appearing only once during a rotation of the transmission gear 77, e.g., the falling position of the signal, or an intermediate position between the falling and rising positions.

Thereafter, the control section 100 determines whether or not the current phase θ of the transfer roller 60 reaches the position of the origin (S17). Such a determination is made based on the detection result of the rotary encoder 89, and information about the position of the origin stored in the RAM 103. When determining that the current phase θ of the transfer roller 60 is not yet at the position of the origin (S17: NO), the control section 100 keeps driving the LF motor 85 until the current phase θ of the transfer roller 60 reaches the position of the origin. When determining that the current phase θ of the transfer roller 60 is now at the position of the origin (S17: YES), the control section 100 stops the driving of the LF motor 85 (S18), and ends the flushing (S19).

When the transfer roller 60 is rotated once without determining that the output from the sheet detection sensor 32 is HI in level (S13: NO), more specifically, when determining that the number of the pulse signals provided by the rotary encoder 89 is now 8640 (S14: YES), the control section 100 determines that the object 91 of the sensing member 90 is not detected. The control section 100 thus makes an error display on the display of the operation panel 14 (S15), stops the driving of the LF motor 85 (S18), and ends the flushing (S19).

Transfer Operation of Printing Paper 50

Figure 13:
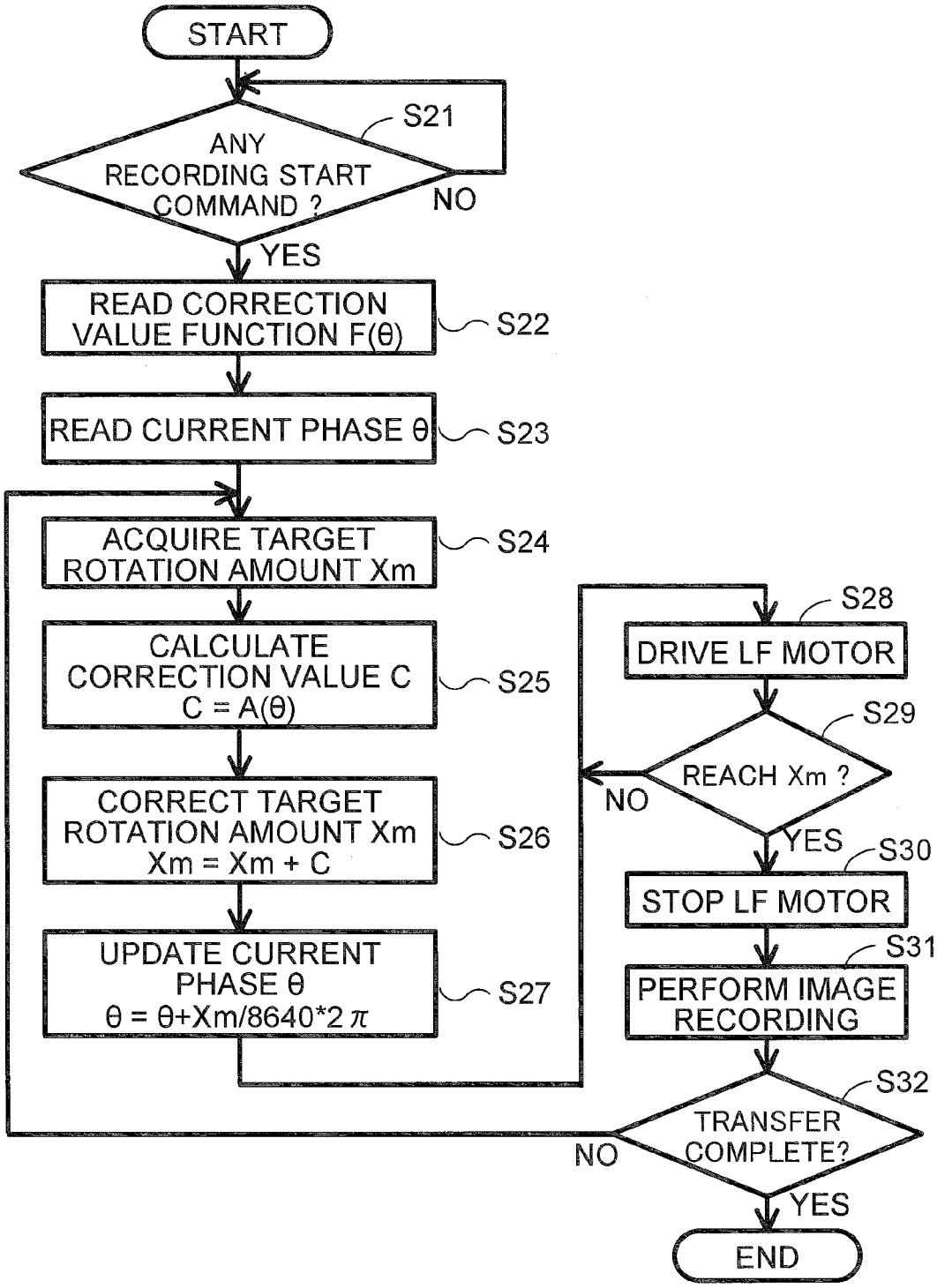
FIG. 13 is an exemplary flowchart of a process procedure to be executed in the multifunctional device in response to when a printing start command is provided.

By referring to the flowchart of FIG. 13, described now is the process procedure to be executed in the printer section 11 when a printing start command is provided to the multifunctional device 10.

The control section 100 determines whether a printing start command is provided or not (S21). More specifically, the control section 100 determines whether or not receiving, from an external information device, a printing start command and printing data, or whether or not any operation input is made on the operation panel 14 to start printing. When determining that such a printing start command is not yet provided (S21: NO), the control section 100 is put on standby.

When determining that such a printing start command is provided (S21: YES), the control section 100 reads the correction value function A(θ) from the EEPROM 104 (S22). The control section 100 then reads the current phase θ of the transfer roller 60 from the RAM 103 (S23). This current phase θ represents the rotation angle of the transfer roller 60 from the position of the origin. Next, the control section 100 acquires a target rotation amount Xm, which is the number of the pulse signals provided by the rotary encoder 89 until the printing paper 50 is moved to the target position (S24). The control section 100 then substitutes the current phase θ into the correction value function A(θ) read in step S22, thereby computing a correction value C representing the number of the pulse signals (S25).

The control section 100 corrects the target rotation amount Xm by adding the correction value C to the target rotation amount Xm acquired by the process in step S24 (S26). The control section 100 then updates the current phase θ based on the target rotation amount Xm as a result of the correction as above (S27). Herein, because the current phase θ represents the rotation angle of the transfer roller 60 from the position of the origin, when the value becomes larger than 2π, 2π is subtracted from the value. When the value becomes negative, the value is added with 2π. In such a manner, the value of the current phase θ is so adjusted as to always satisfy the relationship of $0 \leqq \theta \leqq 2\pi$. Note that described above is the case that the phase of the transfer roller 60 is the radian, but alternatively, any other unit proportional to the radian may be surely an option.

Next, the control section 100 drives the LF motor 85 (S28). The control section 100 then determines whether or not the rotation amount of the transfer roller 60 detected by the rotary encoder 89 reaches the target rotation amount Xm as a result of the correction by the process in step S26 (S29). More specifically, the control section 100 determines whether or not the number of the pulse signals provided by the rotary encoder 89 reaches the target rotation amount Xm. When the control section 100 determines that the rotation amount of the transfer roller 60 does not yet reach the target rotation amount Xm (S29: NO), the procedure is returned to step S28. That is, the LF motor 85 is continuously driven until the rotation amount of the transfer roller 60 reaches the target rotation amount Xm.

During the rotation of the transfer roller 60, a cyclic difference is generated to the actual rotation amount of the transfer roller 60 from the rotation amount thereof detected by the rotary encoder 89. The cyclic difference is with a cycle of the rotation of the transfer roller 60. In this embodiment, based on the position of the origin of the transfer roller 60 acquired after the multifunctional device 10 is turned on, the current phase θ of the transfer roller 60 is determined, and the target rotation amount Xm is corrected using the correction value C corresponding to the current phase θ. As such, the driving of the LF motor 85 is so controlled that the rotation amount of the transfer roller 60 matches considering the target rotation amount Xm as a result of the correction. The cyclic difference observed in the rotation amount of the transfer roller 60 is thus cancelled out so that the printing paper 50 can be transferred with good accuracy to the target position.

When determining that the rotation amount of the transfer roller 60 reaches the target rotation amount Xm (S29: YES), the control section 100 stops the driving of the LF motor 85 (S30). The control section 100 then makes the printing section 40 to perform image printing (S31). To be more specific, the control section 100 moves the carriage 41 from one end side to the other end side in the cross direction 121, and at the same time, bursts the ink from the printhead 42.

The control section 100 then determines whether or not the transfer operation of the printing paper 50 is completed (S32). When the control section 100 determines that the transfer operation of the printing paper 50 is not yet completed (S32: NO), the procedure is returned to step S24. That is, the procedure repeats the processes from steps S24 to S29. As such, the process of rotating the transfer roller 60 by the target rotation amount Xm is repeated alternately with the process of image printing on the printing paper 50 so that the printing paper 50 is sequentially recorded with images. When the control section 100 determines that the transfer operation of the printing paper 50 is completed (S32: YES), this is the end of the process procedure.

Advantages and Effects of Embodiment

As described in the foregoing, the position of the origin of the transfer roller 60 is determined by the sheet detection sensor 32 detecting the object 91 of the sensing member 90. The sheet detection sensor 32 here is the one mounted to the carriage 41 at the end position, and the sensing member 90 here is the one to be moved to slide in conjunction with the rotation of the transfer roller 60. Accordingly, by effectively utilizing the components provided in the printer section 11 for any other purposes, e.g., the sheet detection sensor 32, and the transmission gear 77, the position of the origin of the transfer roller 60 can be determined without causing any possible increase of device size and cost.

Also in the embodiment, the correction value C corresponding to the current phase θ of the transfer roller 60 is acquired by applying the current phase θ of the transfer roller 60 to the correction value function A(θ) stored in the EEPROM 104. The current phase θ of the transfer roller 60 here is the one found with reference to the position of the origin determined by the control section 100. By using the correction value C acquired as such, the target rotation amount Xm is corrected. With the rotation of the transfer roller 60 by the target rotation amount Xm after the correction as such, the cyclic variation of the printing paper 50 in terms of transfer amount can be suppressed. As a result, the printing paper 50 will be transferred intermittently with almost a constant line-feed width so that the printing paper 50 can be recorded thereon with clear images with no disturbance.

Also in the embodiment, the printhead 42 is subjected to flushing at the end position during the detection of the position of the origin of the transfer roller 60. Therefore, during the detection of the position of the origin as such, the area in the vicinity of the nozzles of the printhead 42 may not dry as previously has been, thereby being able to prevent any possible clogging of the ink.

Also in the embodiment, when the carriage 41 is moved to the end position, if the protrusion 80 of the transmission gear 77 is contacting with the object 91 of the sensing member 90, i.e., if the signal provided by the sheet detection sensor 32 is determined as HI in level, the carriage 41 is moved to the home position once by rotating the transfer roller 60 by the amount other than the integral of a rotation cycle, and then moves the carriage 41 back to the end position again. As such, the protrusion 80 of the transmission gear 77 is put in the state of not contacting with the object 91 of the sensing member 90. This accordingly enables to determine the origin of the transfer roller 60 without fail.

In the embodiment above, described is the configuration in which the object 91 of the sensing member 90 is moved to slide by the protrusion 80 formed to the transmission gear 77. Alternatively, the drive transmission mechanism may be well-known type such as gear, belt, cam, or others.

Also in the embodiment above, described is the configuration in which the rotary encoder 89 is used to detect the rotation amount of the transfer roller 60. This is surely not restrictive, and as an alternative to the rotary encoder 89, a magnetic sensor or others may be used for detecting the rotation amount of the transfer roller 60. Moreover, the physical amount to be detected by the sheet detection sensor 32 may be the electric or magnetic field of any opposing area. If this is the case, the object 91 of the sensing member 90 may be charged or magnetized differently from the other remaining portions in terms of amount.

Also in the embodiment, described is the configuration in which an electric signal coming from the sheet detection sensor 32 is determined as either the binary level of HI or LOW based on a predetermined threshold value, and the rising or falling position of the electric signal, i.e., a characteristic point, is used as a basis to determine the position of an origin. Alternatively, the electric signal coming from the sheet detection sensor 32 may not be in binary but may be converted into a digital signal of a plurality of bits such as 8 and 16, or may be handled as an analog value as it is. Moreover, the characteristic point is not restrictive to the rising or falling position of the signal but may be a maximum or minimum value for use as a basis to determine the position of an origin, for example.

Also in the embodiment, described is the configuration in which the LF motor 85 is a DC motor, but alternatively, the LF motor 85 may be a stepping motor. If this is the case, the rotary encoder 89 is not required for use, and the motor pulse count in the control section 100 corresponds to the first sensor.

Also in the embodiment, described is the configuration in which the target rotation amount is corrected only for the transfer roller 60. Alternatively, when the printing paper 50 is transferred only by the sheet ejection roller 62 not going through the transfer roller 60, similarly to the correction of the target rotation amount of the transfer roller 60, the target rotation amount of the sheet ejection roller 62 may be corrected relative to the position of the origin of the transfer roller 60.

First Modified Example

By referring to FIGS. 14A to 14C, described below is a first modified example of the embodiment above. Unlike the embodiment above, in the first modified example, as an alternative to the sensing member 90 in the above embodiment, a sensing member 130 (an example of the reference member) of another configuration is provided. The remaining configuration is the same as that of the embodiment above. Herein, a detailed description is given only about the sensing member 130 but not about the remaining configuration.

Sensing Member 130

Although not shown in the drawings, the sensing member 130 is disposed in the vicinity of an end portion where the transmission gear 77 is positioned on the platen 43. This sensing member 130 is operated by the protrusion 80 of the transmission gear 77.

Figure 14A:
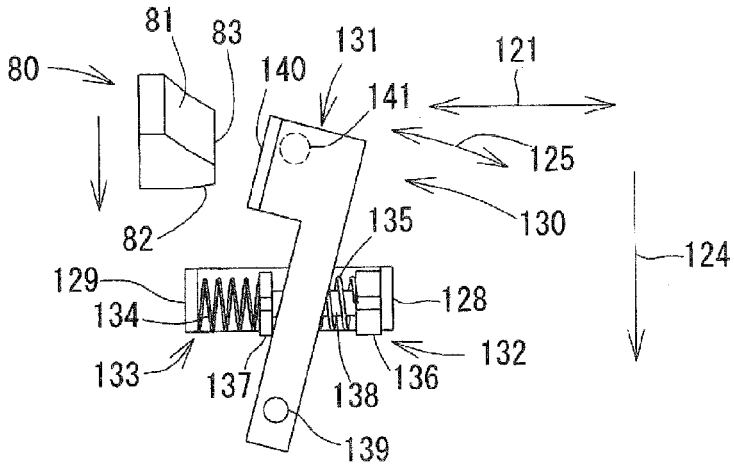
FIGS. 14A to 14C are each a plan view of a reference member in a first modified example, showing the configuration thereof.
Figure 14B:
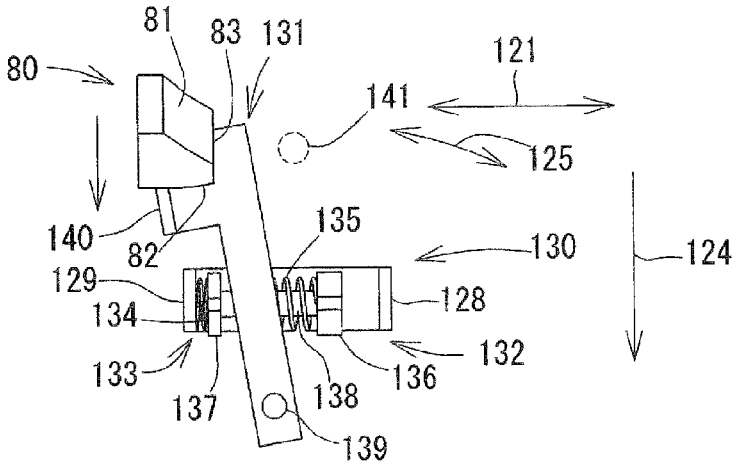
Figure 14C:
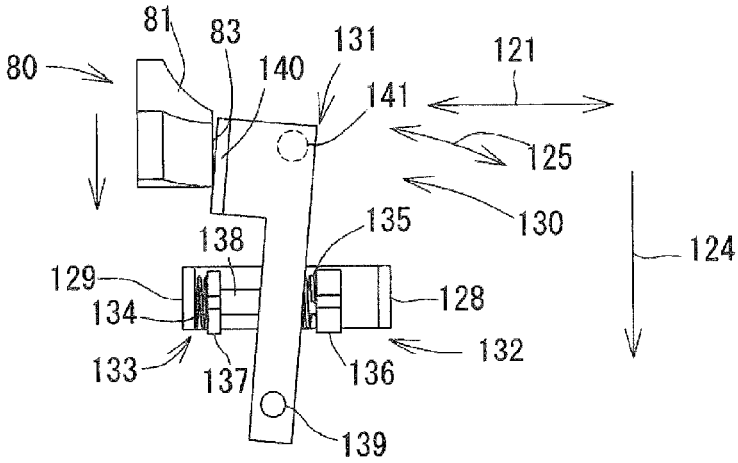

As shown in FIGS. 14A to 14C, the sensing member 130 is configured to mainly include an object 131, a lever 132, a supporting member 133, and coil springs 134 and 135. The supporting member 133 is fixed to the upper surface of the platen 43. This supporting member 133 is incorporated with the object 131 and the lever 132 to be able to slide in the cross direction 121. The supporting member 133 is provided with walls 128 and 129, which are disposed with a distance therebetween in the cross direction 121. The object 131 and the lever 132 are allowed to slide in the cross direction 121 as such between the walls 128 and 129.

The lever 132 is configured by first and second abutting pieces 136 and 137, which are coupled together by a shaft 138. The first and second abutting pieces 136 and 137 are disposed with a distance therebetween in the cross direction 121, and the shaft 138 extends along the cross direction 121. This shaft 138 is coupled with, at its both ends, the first and second abutting pieces 136 and 137, respectively. The first and second abutting pieces 136 and 137 are so disposed that the second abutting piece 137 is located on the side of the transmission gear 77. In a range where the lever 132 is moved to slide in the cross direction 121, the first abutting piece 136 is allowed to come in contact with the wall 128 of the supporting member 133. The position where the first abutting piece 136 comes in contact with the wall 128 of the supporting member 133 as such is the end of the range where the first abutting piece 136 is allowed to slide toward the center in the cross direction 121, i.e., on the right side in FIGS. 14A to 14C. Between the second abutting piece 137 and the wall 129 of the supporting member 133, the coil spring 134 is provided. The second abutting piece 137 and the wall 129 each serve as a spring seat of the coil spring 134. The coil spring 134 is disposed between the second abutting piece 137 and the wall 129 of the supporting member 133, and is compressed. By such a coil spring 134, the lever 132 is biased toward the center in the cross direction 121.

The object 131 is incorporated to the shaft 138 of the lever 132, thereby being allowed to move circular in a rotation direction 125. More in detail, the object 131 is extended all the way to the supporting member 133 and longer from the shaft 139, and is coupled to the shaft 138 to be able to freely slide. The shaft 139 here is the one disposed on the downstream side than the supporting member 133 in the transfer direction 124. The extension end of the object 131 is increased in width in the cross direction 121, and on the side opposing the transmission gear 77, an abutting section 140 is formed. This abutting section 140 is allowed to come in contact with the protrusion 80 of the transmission gear 77. Although the coupling configuration between the object 131 and the shaft 138 of the lever 132 is not shown in the drawings, the object 131 is formed with a coupling section formed with a through hole that projects downward to go through in the cross direction 121. Through this through hole formed to the coupling section, the shaft 138 is inserted so that the object 131 is incorporated to the shaft 138 to be able to freely slide.

The object 131 is so configured as to have a reflectivity different from that of the upper surface of the platen 43. This is for the object 131 to output an electric signal of varying level between when the sheet detection sensor 32 is opposing the object 131, and when it is opposing the upper surface of the platen 43. Such a difference of reflectivity is implemented by a different surface roughness between the object 131 and the upper surface of the platen 43, a different face angle therebetween, a different surface material therebetween, or others. In this embodiment, such a difference of reflectivity is achieved by different coloring between the object 131 and the upper surface of the platen 43. More specifically, the upper surface of the platen 43 is colored black, and the object 131 is colored white.

The coil spring 135 is disposed between the first abutting piece 136 of the lever 132 and the object 131. This coil spring 135 is externally wound around the shaft 138. The first abutting piece 136 and the object 131 each serve as a spring seat of the coil spring 135. The coil spring 135 is disposed between the first abutting piece 136 and the object 131, and is compressed. By such a coil spring 135, the object 131 is biased to move circular toward the outside in the cross direction 121, i.e., on the side of the transmission gear 77.

As shown in FIG. 14A, when the sensing member 130 is free from any external force, the lever 132 is moved to slide toward the center in the cross direction 121 by being biased by the coil spring 134 so that the first abutting piece 136 comes in contact with the wall 128 of the supporting member 133. Moreover, the object 131 is contacting with the second abutting piece 137 by being biased by the coil sprint 135.

As shown in FIG. 14B, when the carriage 41 is moved to the end position, i.e., the position shown in FIG. 3, the abutting section 53 of the carriage 41 comes in contact with the first abutting piece 136 of the lever 132 so that the first abutting piece 136 is moved to slide to the outside in the cross direction 121, i.e., on the left side in FIGS. 14A to 14C, against the biasing force of the coil spring 134. In response to the sliding movement of the lever 132 as such, the object 131 is also moved circular toward the outside in the cross direction 121 together with the lever 132. In this state, the object 131 is contacting with the second abutting piece 137 by being biased by the coil spring 135. In the carriage 41 positioned on the end position, the position to be detected by the sheet detection sensor 32 mounted to such a carriage 41 is a position 141 located on the side closer to the center in the cross direction 121 than the object 131 in the above-described state. That is, the sheet detection sensor 32 detects any light reflected by the upper surface of the platen 43.

As shown in FIG. 14C, when the protrusion 80 of the transmission gear 77 comes in contact with the abutting section 140 of the object 131, against the biasing force of the coil spring 135, the object 131 is moved circular toward the center in the cross direction 121, i.e., on the right side in FIGS. 14A to 14C, along the inclined surface 81 of the protrusion 80. When the surface 83 of the protrusion 80 comes in contact with the object 131, the object 131 accordingly covers the upper side of the position 141. In such a state, the sheet detection sensor 32 mounted to the carriage 41 positioned on the end position detects any light reflected by the object 131.

Second Modified Example

Described next is a second modified example of the embodiment above. Unlike the embodiment above, in the second modified example, as an alternative to the sensing member 90, a sensing mechanism 150 of another configuration is used, and as an alternative to the protrusion 80 of the transmission gear 77, a cam 149 is provided to the shaft 76 of the transfer roller 60. The remaining configuration is the same as that of the embodiment above, and thus a detailed description is given only about the sensing mechanism 150 and the cam 149 but not about the remaining configuration. The sensing mechanism 150 corresponds to the sensing member as an example of the reference member, and the cam 149 corresponds to the position of the drive transmission mechanism.

Sensing Mechanism 150

Figure 15:
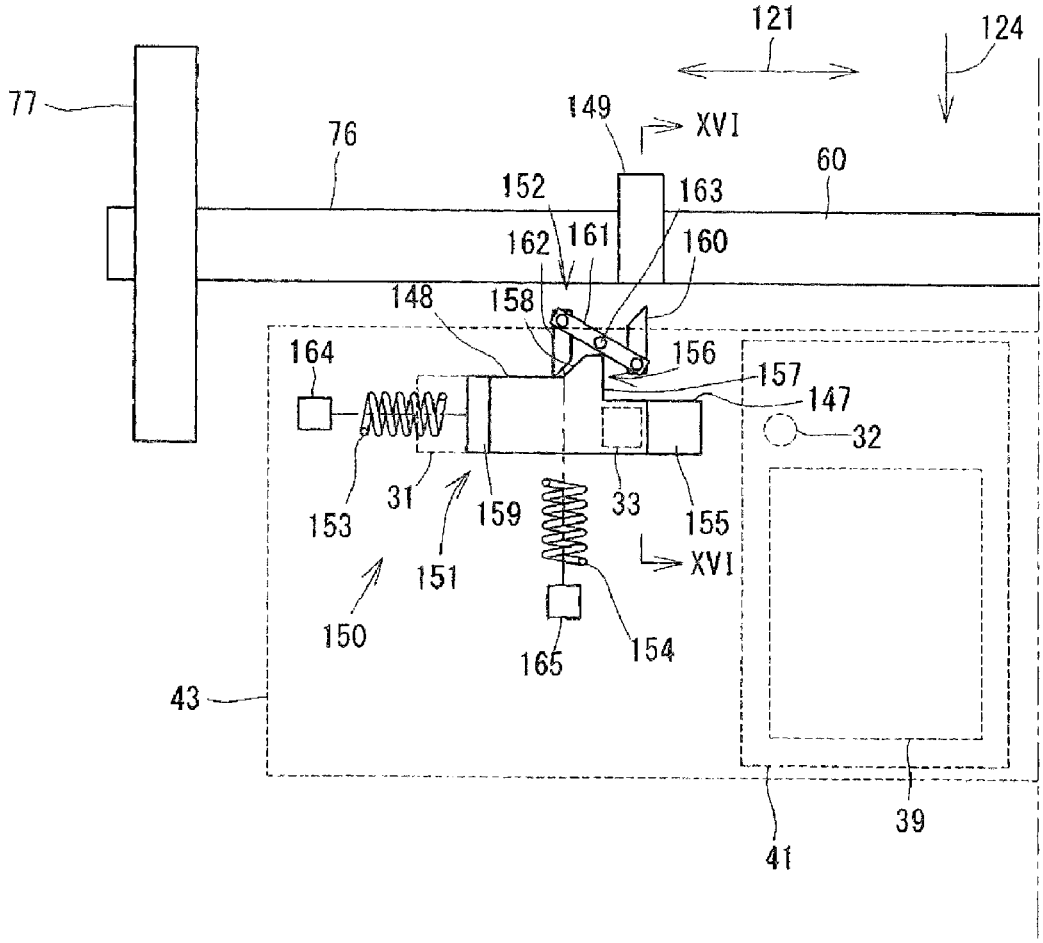
FIG. 15 is a plan view of a reference mechanism in a second modified example, showing the configuration thereof.

As shown in FIG. 15, the sensing mechanism 150 is disposed on the lower side of the platen 43. There is no specific limitation where the sensing mechanism 150 is to be disposed relative to the platen 43 in the cross direction 121. This sensing mechanism 150 is the one operated by the carriage 41 and the cam 149. Note that, in FIG. 15, the platen 43 and a window 33 are each indicated by broken lines. The window 33 is a through hole formed to one of the two ends of the platen 43 in the cross direction 121, i.e., the end on the side of the transmission gear 77, to correspond to the sheet detection sensor 32 in the transfer direction 124.

As shown in FIG. 15, the sensing mechanism 150 is configured to mainly include an object 151, a release lever 152, and coil springs 153 and 154. The object 151 is supported on the rear side of the platen 43 to be able to slide in the cross direction 121. The object 151 is shaped like a flat plate extending long in the cross direction 121, and an end portion on the center side in the cross direction 121, i.e., on the right side in FIG. 15, serves as a detection section 155. This detection section 155 is so configured as to have a reflectivity different from that of other remaining components. This is for the detection section 155 to output an electric signal of varying level between when the sheet detection sensor 32 is opposing the detection section 155, and when it is opposing the other remaining components. In this modified example, the detection section 155 is colored white, and the other remaining components are colored black.

Almost at the center of the object 151 in the cross direction 121, an engaging portion 156 is formed to project toward the shaft 76 of the transfer roller 60. The engaging portion 156 is a surface 157 on the center side in the cross direction 121, i.e., on the right side in FIG. 15, placed along the transfer and height directions 124 and 122. On the other hand, in the engaging portion 156, a surface 158 on the side of the transmission gear 77 in the cross direction 121, i.e., on the left side in FIG. 15, is so inclined to the side of the transmission gear 77.

In the object 151, the surface on the upstream side in the transfer direction 124 varies in position with respect to the engaging portion 156 in the transfer direction 124 on the both sides in the cross direction 121. A surface 147 on the center side from the engaging portion 156 in the cross direction 121 is located on the downstream side than a surface 148 on the side of the transmission gear 77 in the transfer direction 124.

At the end of the object 151 on the side of the transmission gear 77 in the cross direction 121, an abutting section 159 is provided to project above the platen 43. This abutting section 159 is projected above the platen 43 through a through hole 31 formed to the platen 43, and the projected end is extended all the way to the position possibly coming in contact with the side surface of the carriage 41. The through hole 31 is formed to be increased in width in the cross direction 121. The width of the resulting through hole 31 is so set as to reach the movement area of the abutting section 159 in accordance with the sliding movement of the object 151 in the cross direction 121.

The release lever 152 is a member configured by three rod members 160, 161, and 162, which are coupled together in the shape of a letter Z. The rod member 161 is incorporated to a shaft 163 to be able to freely rotate. The shaft 163 is the one projecting from the lower surface of the platen 43 in the height direction 122. The rod member 161 is coupled with, on both ends, the rod members 160 and 162, respectively. The rod member 160 coupled on the center side in the cross direction 121, i.e., on the right side in FIG. 15, is extended from one end of the rod member 161 toward the cam 149. This rod member 160 is moved close to and away from the cam 149 along the transfer direction 124 in response to the rotation of the rod member 161. The rod member 162 coupled on the side of the transmission gear 77 in the cross direction 121, i.e., on the left side in FIG. 15, is extended from the remaining end of the rod member 161 toward the object 151. This rod member 162 is moved close to and away from the object 151 along the transfer direction 124 in response to the rotation of the rod member 161. With the movement of the rod member 162 as such, the release lever 152 is moved close to and away from the object 151.

To an end of the object 151 on the side of the transmission gear 77 in the cross direction 121, one end of the coil spring 153 is coupled. This coil spring 153 is extended in the cross direction 121, and the remaining end thereof is coupled to a spring seat 164 projecting from the lower surface of the platen 43. As shown in FIG. 15, the coil spring 153 moves, with its natural length, the detection section 155 of the object 151 from the window 33 of the platen 43 toward the center in the cross direction 121. That is, by the coil spring 153 with the natural length, the detection section 155 is misaligned from the window 33. In this case, the abutting section 159 is positioned on the center side of the through hole 31 in the cross direction 121. When the abutting section 159 is positioned on the side of the transmission gear 77 of the through hole 31 in the cross direction 121, the detection section 155 is aligned with the window 33. That is, the detection section 155 becomes visible from the upper side of the platen 43 through the window 33. Moreover, the engaging portion 156 of the object 151 comes to the position ready for engagement with the release lever 152. At this time, the coil spring 153 is compressed. By the coil spring 153 compressed as such, the object 151 is elastically biased toward the center in the cross direction 121.

To an end of the rod member 162 of the release lever 152 on the downstream side in the transfer direction 124, an end of the coil spring 154 is coupled. This coil spring 154 is extended in the transfer direction 124, and the remaining end thereof is coupled to a spring seat 165 projecting from the lower surface of the platen 43. As shown in FIG. 15, the coil spring 154 biases the rod member 162 as if pulling it to the downstream side in the transfer direction 124. As a result, the end of the rod member 162 on the downstream side in the transfer direction 124 comes in contact with the surface 147 of the object 151 on the upstream side or the surface 148.

Cam 149

Figure 16:
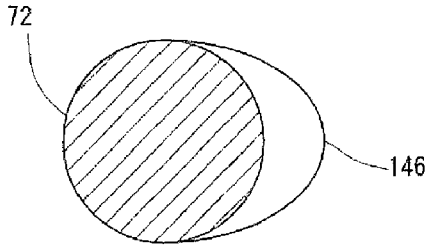
FIG. 16 is a cross-sectional view of the reference mechanism of FIG. 15, showing the cross-sectional configuration thereof cut along a line XVI-XVI.

As shown in FIG. 16, the cam 149 is shaped like a disk whose dimension from the shaft 76 of the transfer roller 60 to the outside in the diameter direction varies depending on the rotation phase of the shaft 76. The cam 149 is formed with a protrusion 146 projecting to the outermost in the diameter direction on the circumferential of the shaft 76. In any portion other than the protrusion 146, the cam 149 does not come in contact with the rod member 160 of the release lever 152 no matter in which position the release lever 152 is (will be described later). The protrusion 146 is projected by the length of, when the release lever 152 is put in the lock position that will be described later, coming in contact with the rod member 160, and moving the rod member 160 in the transfer direction 124 until the release lever 152 is put in the release position.

As shown in FIG. 15, the release lever 152 is in the release position in the normal circumstances. In the cam 149, no matter in which rotation phase, the protrusion 146 never comes in contact with the rod member 160 of the release lever 152 in the release position. The object 151 is moved to slide toward the center in the cross direction 121, and the coil spring 153 has the natural length. The engaging portion 156 of the object 151 is positioned on the center side than the rod member 162 of the release lever 152 in the cross direction 121, and the rod member 162 is contacting with the surface 148 of the object 151 by being biased by the coil spring 154.

Figure 17:
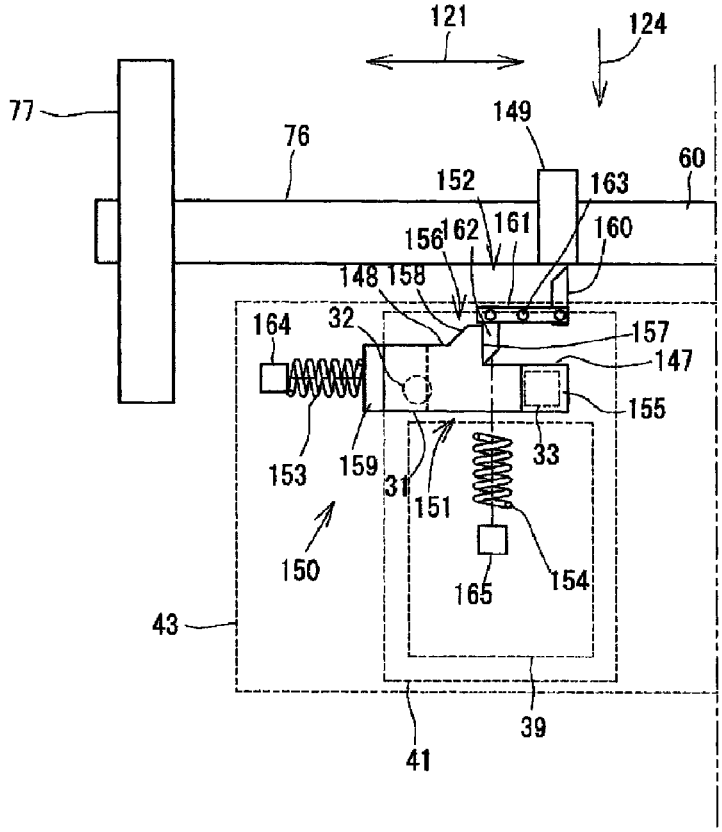
FIG. 17 is a plan view for illustrating the operation of the reference mechanism.

As shown in FIG. 17, when the carriage 41 is moved to the end position, i.e., position shown in FIG. 3, the side surface of the carriage 41 comes in contact with the abutting section 159 of the object 151, and while compressing the coil spring 153, moves the abutting section 159 to slide toward the outside of the through hole 31 in the cross direction 121, i.e., on the left side in FIG. 17. In response to the sliding movement of the abutting section 159 as such, the object 151 is moved to slide to the outside in the cross direction 121. During such a sliding movement, the engaging portion 156 of the object 151 comes in contact with the rod member 162 of the release lever 152. More in detail, the surface 158 of the engaging portion 156 comes in contact with the rod member 162, and the rod member 162 is pushed by the surface 158 in the direction opposite to the transfer direction 124 against the biasing force of the coil spring 154. When the end of the rod member 162 on the downstream side in the transfer direction 124 exceeds the engaging portion 156, by the biasing force of the coil spring 154, the rod member 162 is moved along the transfer direction 124 until it comes in contact with the surface 147. In response to such a movement of the rod member 162, the rod member 160 starts moving along the transfer direction 124 after once moving in the direction opposite thereto. As a result, the release lever 152 is put in the lock position. Due to the engagement between the rod member 162 and the engaging portion 156, the release lever 152 in the lock position serves to restrict the movement of the object 151 toward the center in the cross direction 121 against the biasing force of the coil spring 153. With such a restriction, the detection section 155 of the object 151 is aligned with the window 33 so that the detection section 155 can remain exposed above the platen 43 through the window 33.

Figure 18:
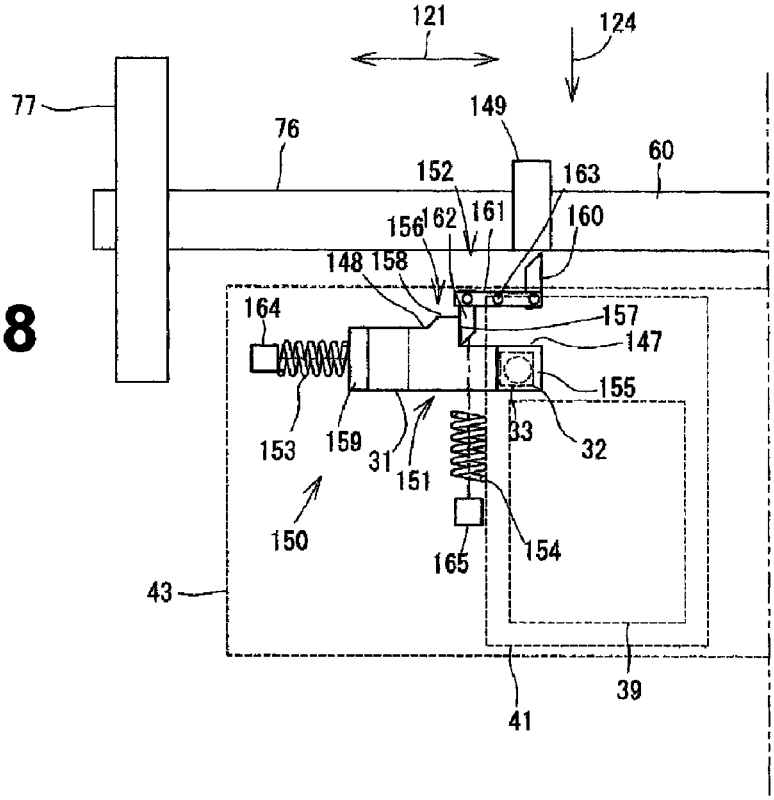
FIG. 18 is another plan view for illustrating the operation of the reference mechanism.

As shown in FIG. 18, the carriage 41 at the end position is moved toward the home position so as to position the sheet detection sensor 32 directly above the window 33. This moves the carriage 41 away from the abutting section 159 of the object 151 but, as described above, the object 151 is remained at the position where the detection section 155 is aligned with the window 33 by the release lever 152 in the lock position. Thereafter, when the sheet detection sensor 32 is turned on, the sheet detection sensor 32 starts detecting any reflected light of the detection section 155. The output signal coming from the sheet detection sensor 32 at this time is determined as HI in level.

Figure 19:
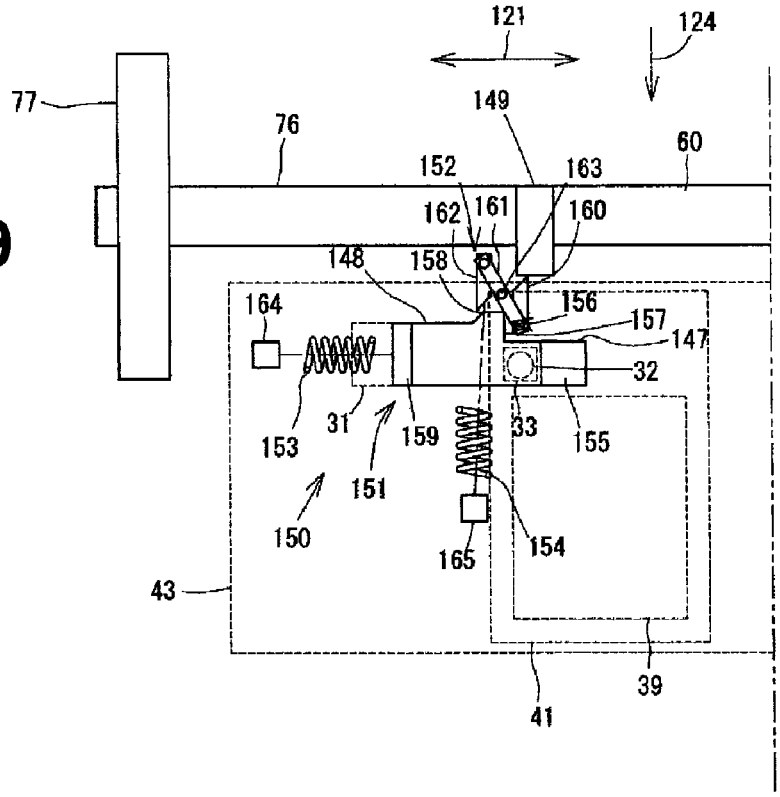
FIG. 19 is still another plan view for illustrating the operation of the reference mechanism.

As shown in FIG. 19, when the transfer roller 60 is rotated in response to the driving of the LF motor 85, the cam 149 attached to the shaft 76 is also rotated. Then when the protrusion 146 of the cam 149 comes in contact with the rod member 160 of the release lever 152, against the biasing fore of the coil spring 154, the rod member 160 is moved in the transfer direction 124. This accordingly changes the position of the release lever 152 from lock to release. When the release lever 152 is in the release position, the end of the rod member 162 on the downstream side in the transfer direction 124 is positioned on the upstream side than the engaging portion 156 of the object 151 in the transfer direction 124. That is, the engagement between the rod member 162 and the engaging portion 156 is released. As a result, the object 151 is moved to slide toward the center in the cross direction 121 by the biasing force of the coil spring 153. By this sliding movement of the object 151, the detection section 155 is misaligned from the window 33 so that the portion of the object 151 other than the detection section 155 is exposed through the window 33. The sheet detection sensor 32 mounted to the carriage 41 stopped in motion at the position corresponding to the window 33 is operated to detect any light reflected by the portion of the object 151 other than the detection section 155. The output signal coming from the sheet detection sensor 32 at this time is determined as LOW in level.

As described in the foregoing, the cam 149 to be rotated in conjunction with the rotation of the transfer roller 60 moves to slide the detection section 155 of the object 151 exposed above the platen 43 through the window 33 so that the control section 100 can detect the position of an origin of the transfer roller 60 based on any change observed in an output signal coming from the sheet detection sensor 32.

Third Modified Example

Described below is a third modified example of the embodiment above. Unlike the embodiment above, in the third modified example, as an alternative to the sensing member 90 in the above embodiment, a drum 170 is provided. Also as an alternative to the protrusion 80 of the transmission gear 77, the shaft 76 of the transfer roller 60 is formed with a spur gear 171, and for engagement with the spur gear 171, a transmission gear 172 is provided. The remaining configuration is the same as that of the embodiment above, and thus a detailed description is thus given only about the drum 170, the spur gear 171, and the transmission gear 172 but not about the remaining configuration. The drum 170 corresponds to a rotation body being the sensing member as an example of the reference member, and the spur gear 171 and the transmission gear 172 each correspond to the drive transmission mechanism. Note that, in FIGS. 20 and 21, the gear teeth are not shown, and in FIG. 20, the components, e.g., the carriage 41 and the platen 43, are each indicated by broken lines.

Drum 170

Figure 20:
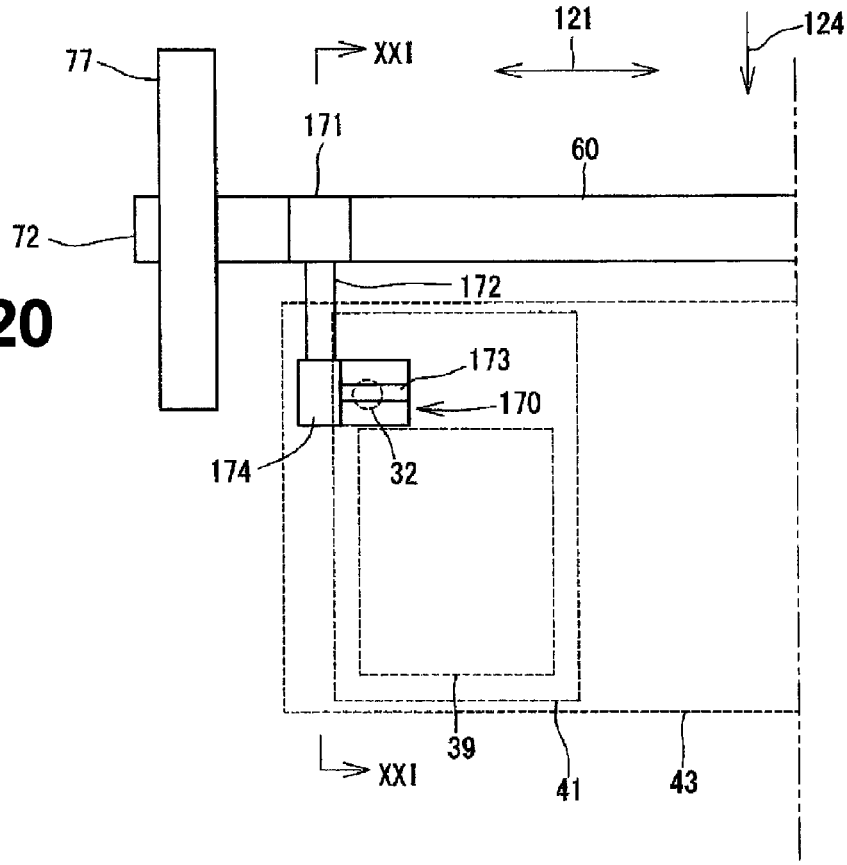
FIG. 20 is a plan view of a drum or others in a third modified example, showing the configurations thereof.
Figure 21:
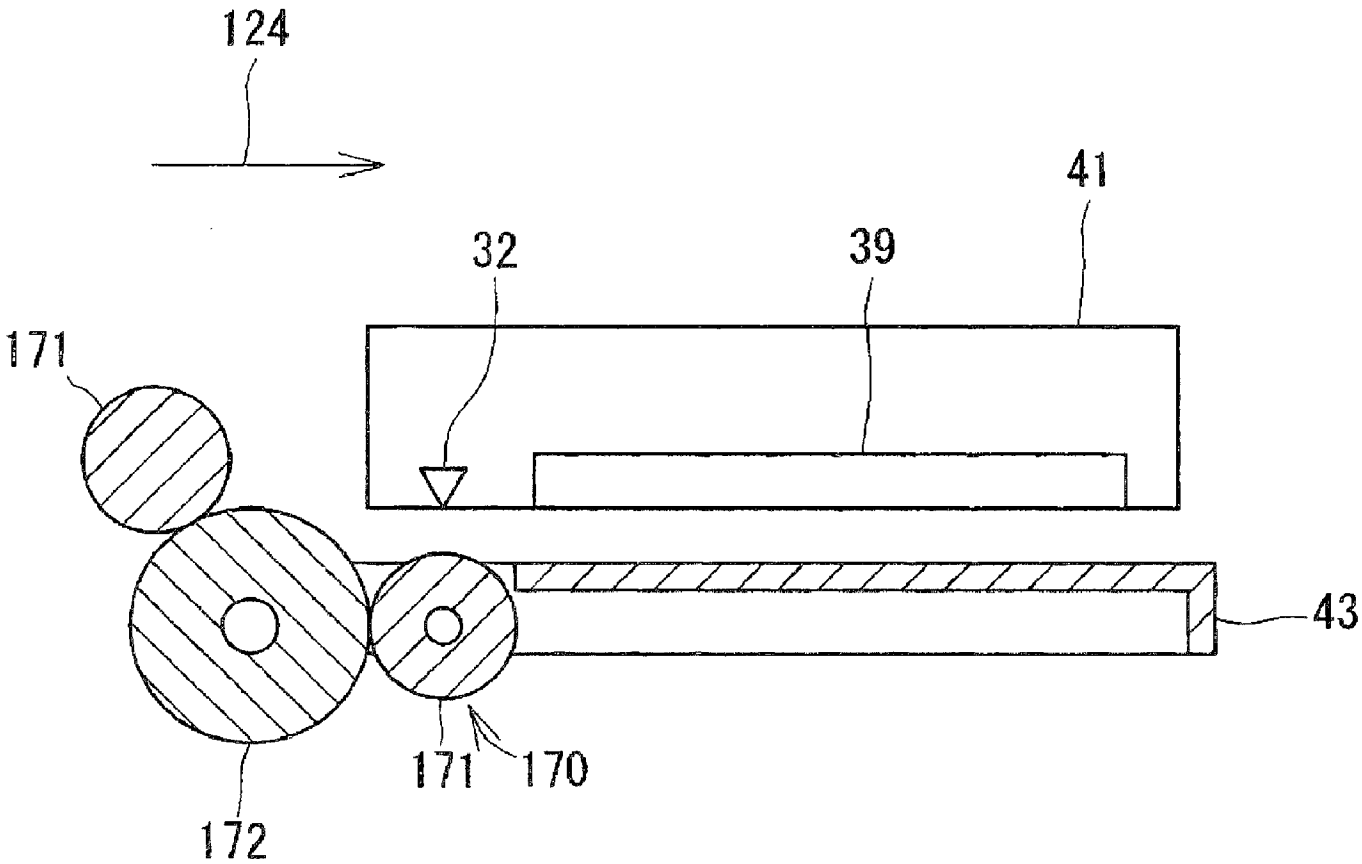
FIG. 21 is a cross-sectional view of the drum or others, showing the cross-sectional configurations thereof cut along a line XXI-XXI.

As shown in FIGS. 20 and 21, the drum 170 is disposed on the lower side of the platen 43. The drum 170 is a member shaped like a cylinder, and is supported on the lower surface side of the platen 43 to be able to freely rotate with the cross direction 121 being the axial direction. The upper surface of the platen 43 is partially notched on the side of the transmission gear 77 in the cross direction 121, and the drum 170 placed thereover is exposed with respect to the upper side of the platen 43. The position of the drum 170 in the transfer direction 124 corresponds to the position of the sheet detection sensor 32 mounted to the carriage 41. Accordingly, when the carriage 41 is moved to the area in the vicinity of the transmission gear 77, the drum 170 is opposed to the sheet detection sensor 32.

As shown in FIG. 21, the circumferential surface of the drum 170 is partially colored so that a detection section 173 is formed. This detection section 173 is so configured as to have a reflectivity different from that of other remaining components. This is for the detection section 173 to output an electric signal of varying level between when the sheet detection sensor 32 is opposing the detection section 173, and when it is opposing the other remaining components. In this embodiment, the detection section 173 is colored white, and the other remaining components are each colored black.

On one end side of the drum 170 in the axial direction, a spur gear 174 is formed. The shaft 76 of the transfer roller 60 is provided with the spur gear 171. This spur gear 171 is disposed in line with the spur gear 174 along the transfer direction 124. In such a manner as to couple together these spur gears 171 and 174, the transmission gear 172 is provided. With such a configuration, the rotation of the shaft 76 of the transfer roller 60 is transmitted to the drum 170. The rotation to be transmitted from the shaft 76 to the drum 170 as such by the spur gears 171 and 174, and by the transmission gear 172 is so proportionally set that the drum 170 makes a rotation while the shaft 76 makes N rotations (where N is a natural number).

As shown in FIGS. 20 and 21, in the carriage 41 at the end position, the sheet detection sensor 32 is opposing the drum 170. When the sheet detection sensor 32 is turned on, the sheet detection sensor 32 starts detecting any reflected light from the drum 170. When the transfer roller 60 is rotated due to the driving of the LF motor 85, the rotation of the shaft 76 is transmitted to the drum 170 via the gears, i.e., the spur gear 171, the transmission gear 172, and the spur gear 174. As described in the foregoing, in response to the rotation of the shaft 76 for N times, the drum 170 makes a rotation. During the rotation of the drum 170 as such, the detection section 173 is opposed only once to the sheet detection sensor 32. When the sheet detection sensor 32 is operated to detect any light reflected by the component(s) other than the detection section 173, an output signal coming from the sheet detection sensor 32 is determined as LOW in level. Moreover, when the sheet detection sensor 32 is operated to detect any light reflected by the detection section 173, the output signal coming from the sheet detection sensor 32 is determined as HI in level. Based on any change observed as such in the output signal from the sheet detection sensor 32, the control section 100 can determine the position of an origin of the transfer roller 60.

Note that, in the embodiment and the modified examples described above, described is the configuration in which the sheet detection sensor 32 is operated to detect a reflectivity. Alternatively, any sensor provided for detecting a distance to the detection target may be used as the sheet detection sensor 32. If this is the configuration, the detection section 155 of the object 151, and the detection section 173 of the drum 170 may be made uneven so as to differ the distance to the sheet detection sensor 32 from the other remaining components.

What is claimed is:

1. An image printing device, comprising:

a transfer roller configured to transfer a printing medium in a transfer direction;

a driving source which rotates the transfer roller;

a first sensor configured to detect a rotation amount of the transfer roller;

a printhead which performs image printing onto the printing medium transferred by the transfer roller;

a carriage configured to move in a movement direction intersecting the transfer direction, the carriage being mounted with the printhead;

a second sensor mounted to the carriage, the second sensor being configured to detect the printing medium;

a reference member disposed at a position opposing to the second sensor;

a drive transmission mechanism configured to move the reference member in conjunction with a rotation of the transfer roller; and a controller configured to control the driving source, the printhead, and the carriage, wherein the controller is configured to:

move the carriage to a detection position where the second sensor detects the reference member;

drive the driving source to move the reference member via the drive transmission mechanism; and determine the position of the origin of the transfer roller based on a detection result of the first sensor, and a detection result of the second sensor.

2. The image printing device according to claim 1, further comprises a memory which stores a correlation between a rotation phase corresponding to a rotation amount of the transfer roller from the position of the origin and a correction value for a target rotation amount of the transfer roller, wherein, based on the determined position of the origin, the detection result of the first sensor, and the correlation stored in the memory, the controller is configured to correct the target rotation amount of the transfer roller, and to drive the driving source in accordance with the corrected target rotation amount of the transfer roller.

3. The image printing device according to claim 1, wherein the printhead performs the image printing by an ink-jet mode, the image printing device further comprises an ink receiving section configured to oppose the printhead when the carriage is at the detection position, and the controller controls the printhead to discharge ink drops from the printhead to the ink receiving section while the position of the origin is detected.

4. The image printing device according to claim 1, wherein the drive transmission mechanism moves the reference member with respect to the carriage in accordance with a predetermined rotation position of the transfer roller.

5. The image printing device according to claim 1, wherein the reference member comprises a rotation body, and the drive transmission mechanism rotates the reference member in conjunction with rotation of the transfer roller.

6. The image printing device according to claim 1, wherein a physical amount to be detected by the second sensor is a reflectivity or a distance of the reference member.

7. The image printing device according to claim 1, wherein the second sensor comprises a light-emitting portion which emits a light and a light-receiving portion which receives a reflected light and outputs a signal in accordance with an amount of the reflected light.

* * * * *